US011569558B2

(12) United States Patent
Takahashi et al.

(10) Patent No.: US 11,569,558 B2
(45) Date of Patent: Jan. 31, 2023

(54) DIRECTIONAL COUPLER FOR USE IN A SUBSTRATE PROCESSING APPARATUS, WHERE THE DIRECTIONAL COUPLER INCLUDES A COAXIAL LINE COUPLED TO A CONDUCTOR ON A SUBSTRATE

(71) Applicant: Tokyo Electron Limited, Tokyo (JP)

(72) Inventors: Isao Takahashi, Nirasaki (JP); Hiroyuki Miyashita, Nirasaki (JP); Yuki Osada, Nirasaki (JP); Mitsuya Inoue, Nirasaki (JP); Mitsutoshi Ashida, Nirasaki (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 79 days.

(21) Appl. No.: 17/155,618

(22) Filed: Jan. 22, 2021

(65) Prior Publication Data

US 2021/0234248 A1 Jul. 29, 2021

(30) Foreign Application Priority Data

Jan. 29, 2020 (JP) ..... JP2020-012640

(51) Int. Cl.
*H01P 5/18* (2006.01)
*H05H 1/46* (2006.01)

(52) U.S. Cl.
CPC ..... *H01P 5/183* (2013.01); *H01P 5/184* (2013.01); *H05H 1/46* (2013.01)

(58) Field of Classification Search
CPC ..... H01P 5/183; H01P 5/182; H01P 5/181; H01P 5/18; H01P 5/184; H01P 5/187; H01P 5/085
USPC ..... 333/115, 116
See application file for complete search history.

(56) References Cited

U.S. PATENT DOCUMENTS

2009/0045887 A1* 2/2009 Tervo ..... H01P 5/185 333/111

FOREIGN PATENT DOCUMENTS

JP 2003-032013 A 1/2003

* cited by examiner

*Primary Examiner* — Benny T Lee
(74) *Attorney, Agent, or Firm* — Nath, Goldberg & Meyer; Jerald L. Meyer; Tanya E. Harkins

(57) ABSTRACT

A directional coupler includes: a hollow coaxial line including a central conductor forming a main line and an outer conductor surrounding the central conductor and having an opening formed therein; a dielectric substrate covering the opening and provided with film-shaped ground conductors, wherein a film-shaped ground conductor covers a rear surface of the dielectric substrate facing the central conductor via the opening and a film-shaped ground conductor covers a front surface of the dielectric substrate, respectively, and are grounded; and a coupling line provided on the rear surface of the dielectric substrate in a region surrounded by the ground conductor formed on the rear surface and serving as an auxiliary line, wherein the ground conductor formed on the front surface is provided with a conductor-removed portion in which a portion of a conductor film in a region facing the coupling line via the dielectric substrate is removed.

20 Claims, 22 Drawing Sheets

DIRECTIONAL COUPLER FOR USE IN A SUBSTRATE PROCESSING APPARATUS, WHERE THE DIRECTIONAL COUPLER INCLUDES A COAXIAL LINE COUPLED TO A CONDUCTOR ON A SUBSTRATE

CROSS-REFERENCE TO RELATED APPLICATION

This application is based upon and claims the benefit of priority from Japanese Patent Application No. 2020-012640, filed on Jan. 29, 2020, the entire contents of which are incorporated herein by reference.

TECHNICAL FIELD

The present disclosure relates to a directional coupler, a substrate processing apparatus, and a substrate processing method.

BACKGROUND

Some apparatuses, which perform a film-forming process or an etching process on a substrate by using a plasmarized processing gas, plasmarize the processing gas by supplying microwaves of high-frequency power to the processing gas.

In order to accurately detect a power level of the microwaves supplied to the processing gas, a directional coupler is used to extract a portion of traveling waves of the microwaves while avoiding influence of reflected waves generated in a supply path of the microwaves.

Patent Document 1 discloses a directional coupler, in which a window is provided in an outer conductor of a coaxial line having a central conductor and the outer conductor, and a substrate for a coupling line is disposed to cover the window, thereby electromagnetically coupling the coupling line with the coaxial line to extract a high-frequency signal from the coupling line.

PRIOR ART DOCUMENT

Patent Document

Patent Document 1: Japanese laid-open publication No. 2003-32013 (Published on Jan. 31, 2003)

SUMMARY OF THE INVENTION

An aspect of the present disclosure provides a directional coupler for extracting portions of a high-frequency power, which flows through a main line, via an auxiliary line that is electromagnetically coupled to the main line. The directional coupler includes: a hollow coaxial line including a central conductor forming the main line and an outer conductor surrounding the central conductor and having an opening formed therein, wherein the hollow coaxial line is connected to an input terminal and an output terminal for the high-frequency power; a dielectric substrate covering the opening and provided with film-shaped ground conductors, wherein a film-shaped ground conductor covers a rear surface of the dielectric substrate facing the central conductor via the opening and a film-shaped ground conductor covers a front surface of the dielectric substrate opposite to the rear surface, respectively, and are grounded; and a coupling line provided on the rear surface of the dielectric substrate at a location facing the central conductor via the opening, and formed in a region surrounded by the ground conductor formed on the rear surface such that the coupling line is electrically non-conductive with the ground conductor formed on the rear surface and serves as the auxiliary line, wherein the coupling line is connected to extraction terminals from which the portions of the high-frequency power are extracted, wherein the ground conductor formed on the front surface is provided with a conductor-removed portion in which a portion of a conductor film in a region facing the coupling line via the dielectric substrate is removed.

BRIEF DESCRIPTION OF THE DRAWINGS

The accompanying drawings, which are incorporated in and constitute a part of the specification, illustrate embodiments of the present disclosure, and together with the general description given above and the detailed description of the embodiments given below, serve to explain the principles of the present disclosure.

DETAILED DESCRIPTION OF THE INVENTION

Reference will now be made in detail to various embodiments, examples of which are illustrated in the accompanying drawings, where like features are denoted by the same reference numbers throughout the detail description of the drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, systems, and components have not been described in detail so as not to unnecessarily obscure aspects of the various embodiments.

Figure 1:
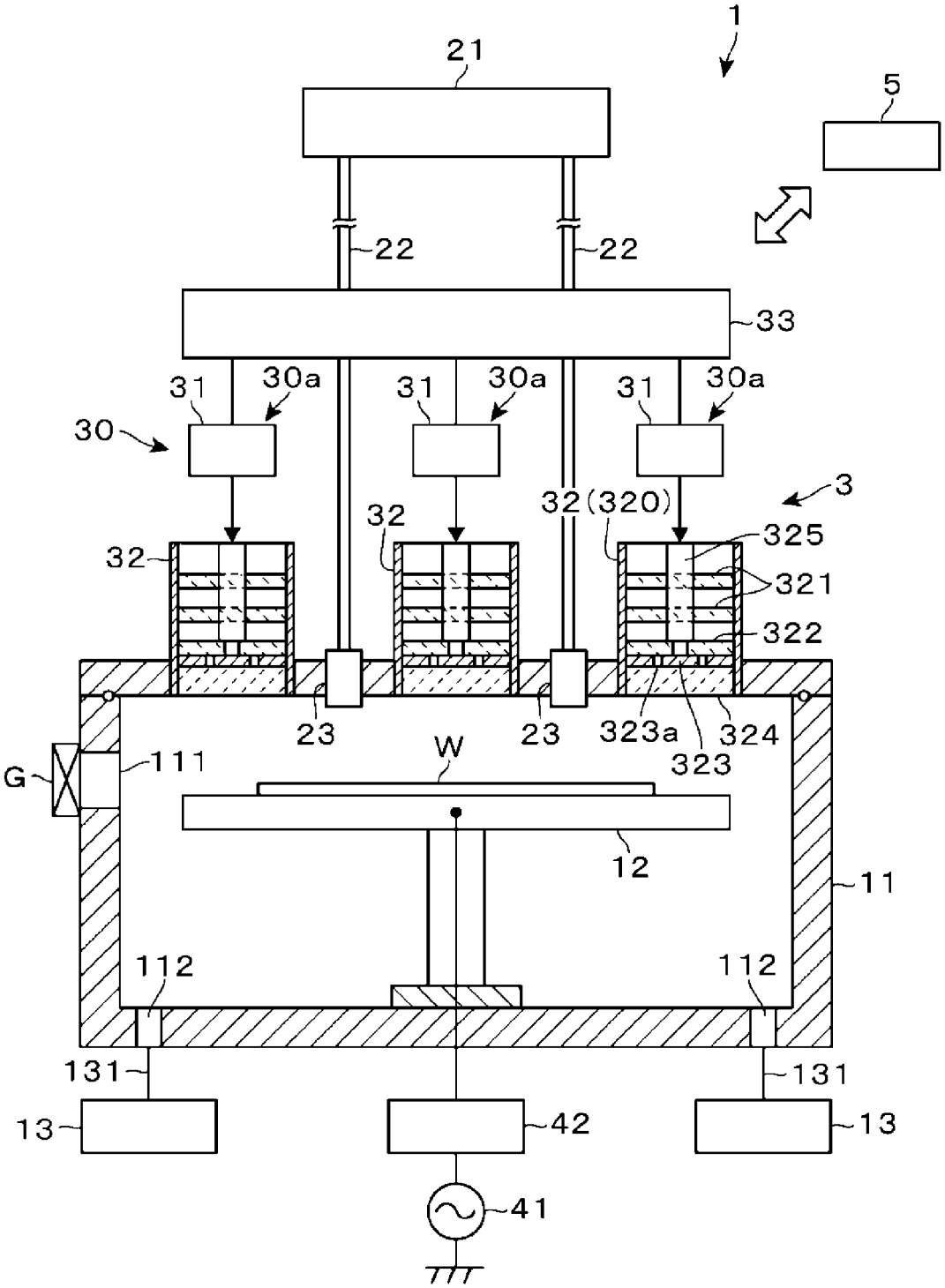
FIG. 1 is a vertical cross-sectional view of a plasma processing apparatus provided with a directional coupler of the present disclosure.

Hereinafter, embodiments of the present disclosure will be described with reference to the drawings. First, with reference to FIG. 1, a schematic configuration of a plasma processing apparatus 1 provided with a directional coupler 6 or 6*a* according to the present disclosure will be described. FIG. 1 is a vertical cross-sectional view illustrating the schematic configuration of the plasma processing apparatus 1 according to the present embodiment.

The plasma processing apparatus 1 according to the present embodiment is an apparatus configured to perform a process using a plasmarized processing gas on, for example, a semiconductor wafer W for manufacturing a semiconductor device (hereinafter, simply referred to as a "wafer"). Examples of the process performed on the wafer W by using the plasmarized processing gas may include a film-forming process, an etching process, and an ashing process.

The plasma processing apparatus 1 includes a processing container 11 configured to accommodate therein the wafer W as a substrate, a stage 12 arranged inside the processing container 11 and configured to place thereon the wafer W to be processed, nozzles 23 configured to supply the processing gas into the processing container 11, an exhaust unit 13 configured to depressurize and exhaust the interior of the processing container 11, a microwave introduction unit 3 configured to introduce microwaves into the processing container 11 in order to generate plasma of the processing gas, and a controller 5 configured to control the respective components of the plasma processing apparatus 1.

The processing container 11 is formed of, for example, a metallic material, and the wafer W is loaded and unloaded through a loading and unloading port 111 provided in a side wall of the processing container 11. The loading and unloading port 111 is opened and closed by a gate valve G.

The stage 12 is disposed inside the processing container 11, in a state of being insulated from the processing container 11. The wafer W loaded into the processing container 11 is processed in a state of being placed on the stage 12. A high-frequency bias power supply 41 is connected to the stage 12 via a matcher 42. The high-frequency bias power supply 41 supplies high-frequency power for drawing ions into the wafer W to the stage 12.

The exhaust unit 13 is connected to a bottom portion of the processing container 11 via exhaust ports 112 and exhaust pipes 131. For example, the exhaust unit 13 is composed of an APC valve and a vacuum pump, and performs vacuum-evacuation such that the inner space of the processing container 11 becomes a preset pressure.

The plurality of nozzles 23 is provided on a ceiling of the processing container 11 at positions facing the wafer W placed on the stage 12. Each nozzle 23 has gas supply holes (not illustrated), and is connected to a processing gas supplier 21 via a pipe 22. Depending on the process performed on the wafer W by the plasma processing apparatus 1, a processing gas for performing a film-forming process, an etching process, or an ashing process, a rare gas for assisting generation of plasma of the processing gas, and a purge gas for discharging the processing gas from the interior of the processing container 11 are supplied from the processing gas supplier 21.

Figure 2:
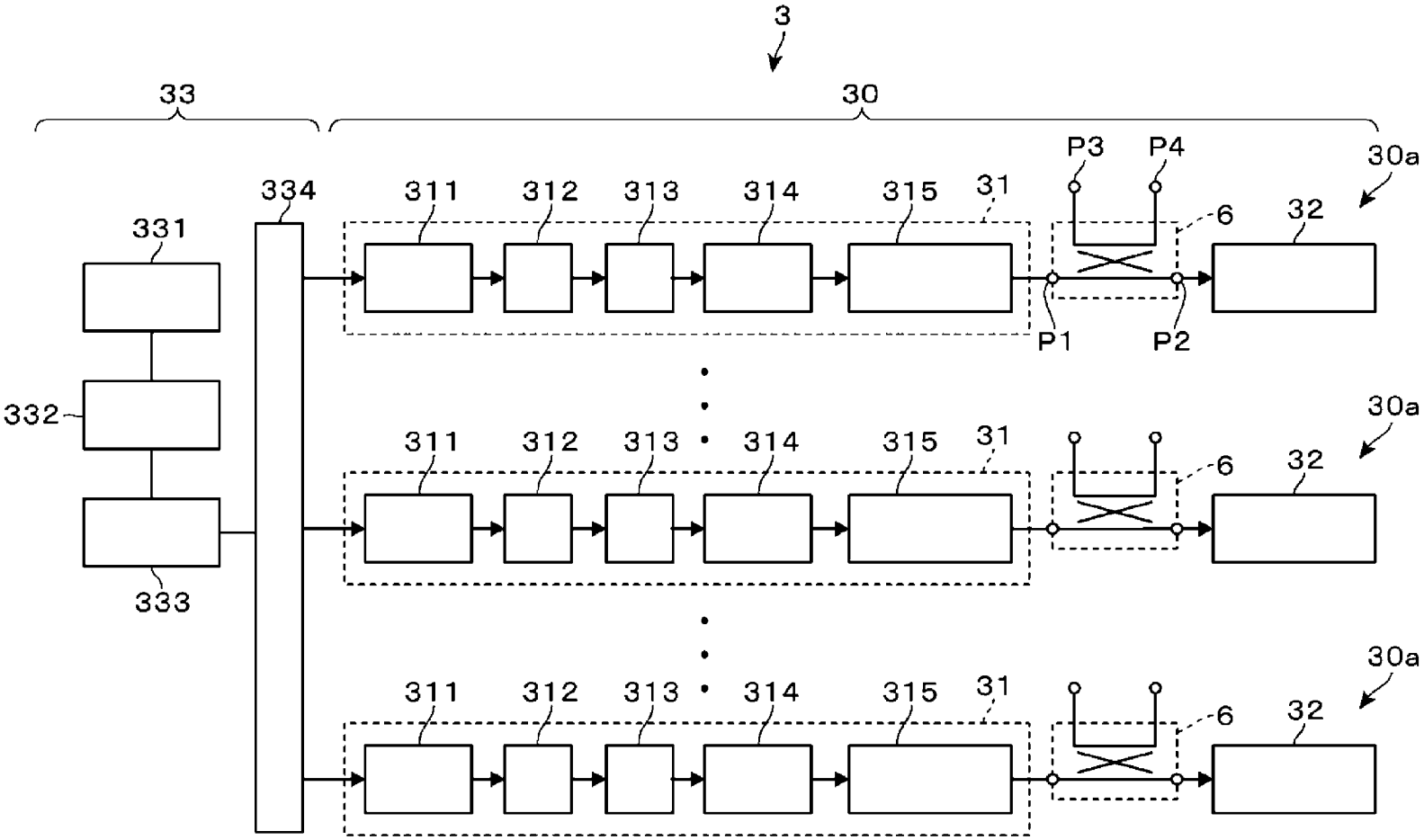
FIG. 2 is a view illustrating a configuration of a microwave introduction unit.

Next, a configuration of the microwave introduction unit 3 will be described with reference to FIG. 2. FIG. 2 is an explanatory view illustrating the configuration of the microwave introduction unit 3.

The microwave introduction unit 3 has a function of introducing microwaves of high-frequency power into the processing container 11 in order to plasmarize the processing gas supplied into the processing container 11 as shown in FIG. 1. For example, the microwave introduction unit 3 is provided in an upper portion of the processing container 11.

As illustrated in FIG. 1, the microwave introduction unit 3 includes a microwave output part 33 configured to generate microwaves and distribute and output the microwaves to a plurality of paths, and an antenna unit 30 configured to introduce the microwaves output from the microwave output part 33 into the processing container 11.

As illustrated in FIG. 2, the microwave output part 33 includes a power supply 331, a microwave oscillator 332, an amplifier 333 configured to amplify the oscillated microwaves, and a distributor 334 configured to distribute the microwaves amplified by the amplifier 333 into the plurality of paths.

The microwave oscillator 332 oscillates the microwaves at a predetermined frequency from 800 MHz to 1 GHz (e.g., 860 MHz). The frequency of the microwaves is not limited to the frequency within the above frequency range, and may be, for example, 8.35 GHz, 5.8 GHz, 2.45 GHz, or 1.98 GHz. The distributor 334 distributes the microwaves while matching impedances on an input side and on an output side.

The antenna unit 30 includes a plurality of antenna modules 30*a*. Each of the antenna modules 30*a* introduces the microwaves distributed by the distributor 334 into the processing container 11. In the present embodiment, the plurality of antenna modules 30*a* has the same configuration.

Each antenna module 30*a* includes an amplifier part 31 configured to amplify the distributed microwaves, and a microwave introduction mechanism 32 configured to introduce the microwaves output from the amplifier part 31 into the processing container 11.

Figure 3:
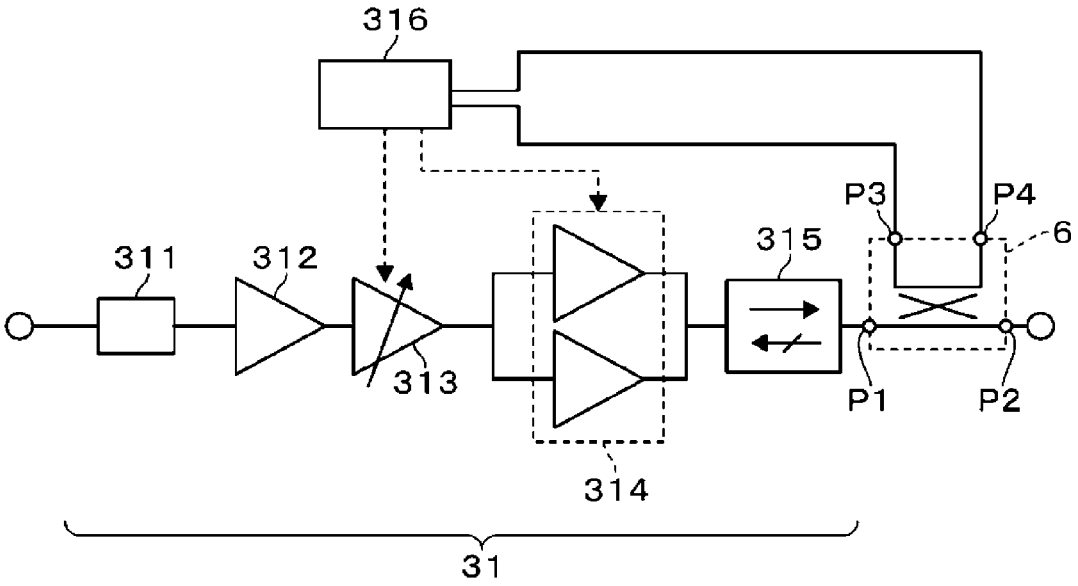
FIG. 3 is a block diagram of an antenna unit provided with the directional coupler.

As illustrated in FIG. 3, the amplifier part 31 includes a phase shifter 311 configured to change a phase of microwaves, a small power amplifier 312 configured to perform first-stage amplification, a driver amplifier 313 configured to adjust a power level of microwaves, a power amplifier 314 configured as a solid-state amplifier, and an isolator 315 configured to separate reflected waves of the microwaves, which are reflected by the microwave introduction mechanism 32 to be described later toward the power amplifier 314.

The phase shifter 311 can change a phase of microwaves so as to change radiation characteristics of the microwaves. The phase shifter 311 is used to change distribution of plasma by controlling directivity of the microwaves by, for example, adjusting the phase of the microwaves for each antenna module 30*a*. In a case of not adjusting the radiation characteristics as described above, the phase shifter 311 may not be provided.

The small power amplifier 312 amplifies the microwaves having the phase which has been adjusted by the phase shifter 311 with a preset gain.

The driver amplifier 313 is used for adjusting a variation in power of the microwaves of each antenna module 30*a* and adjusting an intensity of plasma. For example, a distribution of plasma in the entirety of the processing container 11 may be adjusted by changing the gain of the driver amplifier 313 for each antenna module 30*a*, based on a detection result of the power level of the microwaves output from the amplifier part 31.

The power amplifier 314 amplifies the output of the microwaves having the power which has been adjusted by the driver amplifier 313 to a desired power level. For example, the power amplifier 314 is composed of, for example, baluns (an input side and an output side), matching circuits (an input side and an output side), and a semiconductor amplification element. As a semiconductor amplification element, for example, GaAs PHEMT (Gallium Arsenide Pseudomorphic High Electron Mobility Transistor), GaAs MESFET (Gallium Arsenide Metal-Semiconductor Field Effect Transistor), GaN HEMT (Gallium Nitride High Electron Mobility Transistor), or LDMOS (Laterally-Diffused Metal-Oxide Semiconductor) is used.

The isolator 315 has a circulator and a dummy load (a terminating resistor). The circulator guides reflected microwaves reflected by an antenna portion of the microwave introduction mechanism 32, which will be described later, to the dummy load. The dummy load converts the reflected microwaves guided by the circulator into heat.

A portion of the microwaves output from the amplifier part 31 having the configuration described above is extracted by using the directional coupler 6 of the present embodiment (first embodiment) to be described later, for detecting the power level.

As will be described later, the directional coupler 6 may extract a portion of the traveling waves of the microwaves output from the amplifier part 31 and a portion of the reflected waves of the microwaves. In the example illustrated in FIG. 3, the portion of the microwaves extracted by the directional coupler 6 is input to a power controller 316 and used as high-frequency signals for detecting a power level of each of the traveling waves and the reflected waves.

As will be described later, the directional coupler 6 may extract a part of the traveling waves of the microwaves output from the amplifier part 31 and a part of the reflected waves of the microwaves. In the example illustrated in FIG. 3, the part of the microwaves extracted by the directional coupler 6 is input to a power controller 316 and used as high-frequency signals for detecting a power level of each of the traveling waves and the reflected waves.

The power controller 316 obtains the power levels of the traveling waves and reflected waves of the microwaves at the outlet of the amplifier part 31 based on signal levels of the high-frequency signals. In addition, the power controller 316 perform gain adjustment of the driver amplifier 313 and matching adjustment of the power amplifier 314 based on the detection result of the power levels.

The microwaves output from the amplifier part 31 are input to the microwave introduction mechanism 32. A configuration of the microwave introduction mechanism 32 will be described in brief with reference to FIG. 1. In the microwave introduction mechanism 32, a hollow coaxial line is constituted by a cylindrical body container 320 forming an outer conductor and an inner conductor 325 extending along a central axis of the body container 320. A space between an inner peripheral surface of the body container 320 and an outer peripheral surface of the inner conductor 325 serves as a microwave transmission path.

In the microwave transmission path, two annular slugs 321 formed of a dielectric material are spaced apart from each other in a vertical direction. Vertical positions of the slugs 321 are adjusted by an actuator (not illustrated) such that an impedance when the microwave introduction mechanism 32 is viewed from the amplifier part 31 becomes a predetermined value, whereby the slugs 321 serve as a tuner.

On a side of the outlet of the microwave transmission path, the antenna part, which includes a planar antenna 323 connected to a lower end of the inner conductor 325, a microwave retardation member 322 arranged on a top surface of the planar antenna 323, and a microwave transmission window 324 arranged on the bottom surface of the planar antenna 323, are provided.

The planar antenna 323 has a plurality of slots (openings) 323*a*. The microwave retardation member 322 is formed of, for example, quartz, and adjusts plasma by shortening a wavelength of the microwaves. The microwave transmission window 324 is formed of a dielectric material such as quartz or ceramic, and closes an opening formed in the ceiling of the processing container 11.

The microwaves, which have reached the planar antenna 323 via the microwave transmission path, penetrate the microwave transmission window 324 via the slots 323*a* of the planar antenna 323, and are radiated in a TE mode.

When the microwaves are radiated into the processing container 11 to which a processing gas has been supplied via the nozzle 23 described above, the processing gas is plasmarized. In addition, a desired process is performed on the wafer W placed on the stage 12 by using active species (radicals and ions) generated by the plasmarization of the processing gas. A region below the microwave transmission window 324, in which the microwaves are radiated and plasma of the processing gas is formed, corresponds to a plasma forming part of the present embodiment.

The respective components of the plasma processing apparatus 1 having the configuration described above are connected to the controller 5 and controlled by the controller 5. The controller 5 is configured by a computer having a CPU and a storage, and controls the respective components of the plasma processing apparatus 1. A program, in which a group of steps (instructions) for executing operations required for processing the wafer W is set, is recorded in the storage. The program is stored in a storage medium such as a hard disk, a compact disk, a magneto-optical disk, or a memory card, and is installed in the computer from the storage medium.

In the plasma processing apparatus 1 having the configuration described above, as described above with reference to FIG. 2, a portion of the microwaves output from the amplifier part 31 is extracted as high-frequency signals by the directional coupler 6, and is used to detect the power level of the microwaves.

Before describing the detailed configuration of the directional coupler 6 according to the present embodiment (first embodiment), indices for evaluating performance of the directional coupler 6 will be described.

Figure 4:
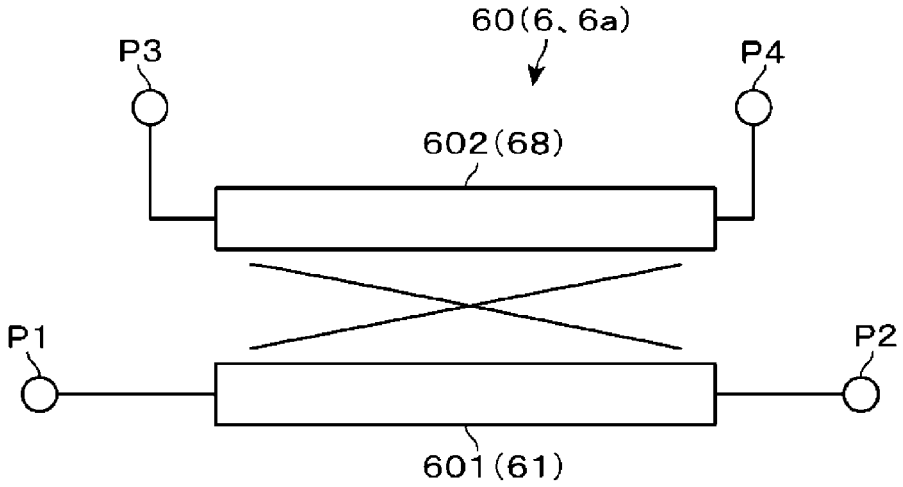
FIG. 4 is a schematic view of a directional coupler.

FIG. 4 illustrates a schematic view of a backward-type directional coupler 60. The directional coupler 60 is a device that electromagnetically couples an auxiliary line 602 to a main line 601, through which high-frequency power flows, and extracts a portion of the high frequency power from the auxiliary line 602 as a high-frequency signal.

In FIG. 4, reference symbol P1 denotes an input port through which the high-frequency power is input to the main line 601, and reference symbol P2 denotes an output port through which the high-frequency power is output from the main line 601. In the backward-type directional coupler 60, a portion of the traveling waves of the high-frequency power flowing through the main line 601 is extracted from a location denoted by reference symbol P3 in the auxiliary line 602, and P3 is called a coupling port. In addition, a portion of the reflected waves of the high-frequency power flowing through the main line 601 is extracted from a location denoted by reference symbol P4 in the auxiliary line 602, and P4 is called an isolation port.

Reference symbols P1 to P4 added to the directional couplers 6 and 6*a* according to the embodiments to be described later also mean the respective ports described above.

A reflection loss, a passage loss, a coupling characteristic, an isolation characteristic, and a directional characteristic are defined as indices for evaluating the performance of the directional coupler 60 (6, 6*a*). Respective indices may be obtained by the following Equations (1) to (5) by using S parameters expressed in decibels (dB).

$$\text{Reflection loss of each port}=Sii\,[\text{dB}]\,(i=1,2,3,4)\,(\text{e.g., } S11, S22, S33, S44) \quad (1)$$

$$\text{Passage loss}=S21\ [\text{dB}] \quad (2)$$

$$\text{Coupling characteristic}=S31\ [\text{dB}] \quad (3)$$

$$\text{Isolation characteristic}=S41\ [\text{dB}] \quad (4)$$

$$\text{Directional characteristic}=S31-S41\ [\text{dB}] \quad (5)$$

As the performance required for the directional coupler 60, it is preferable that high-frequency power having a required level can be extracted from the coupling port P3 and components of traveling waves leaking to the isolation port P4 is small. That is, the directional coupler 60 is required to have a large value of the directional characteristic S31-S41 while having a value of the coupling characteristic S31 within a preset target range.

Meanwhile, in the microwave introduction unit 3 described above with reference to FIG. 2, the power level of the microwaves output from each amplifier part 31 is several hundred watts. In this case, it is sufficient to obtain a small amount of electric power for microwave monitoring. Thus, the directional coupler 6 is designed such that the coupling characteristic S31≤−30 dB is satisfied, for example.

When a small amount of power is extracted from the main line 601 through which a large amount of power flows as described above, the electromagnetic coupling state between the main line 601 and the auxiliary line 602 (a coupling line 68 to be described later) needs to be a loosely-coupled state. In general, however, the loosely-coupled directional coupler 60 has a problem in that it is difficult to improve the directional characteristic thereof.

The directional coupler 6 of the present embodiment has a configuration capable of improving the directional characteristic while loosely coupling the coupling line 68 as the auxiliary line 602 to a central conductor 61 as the main line 601.

Figure 5:
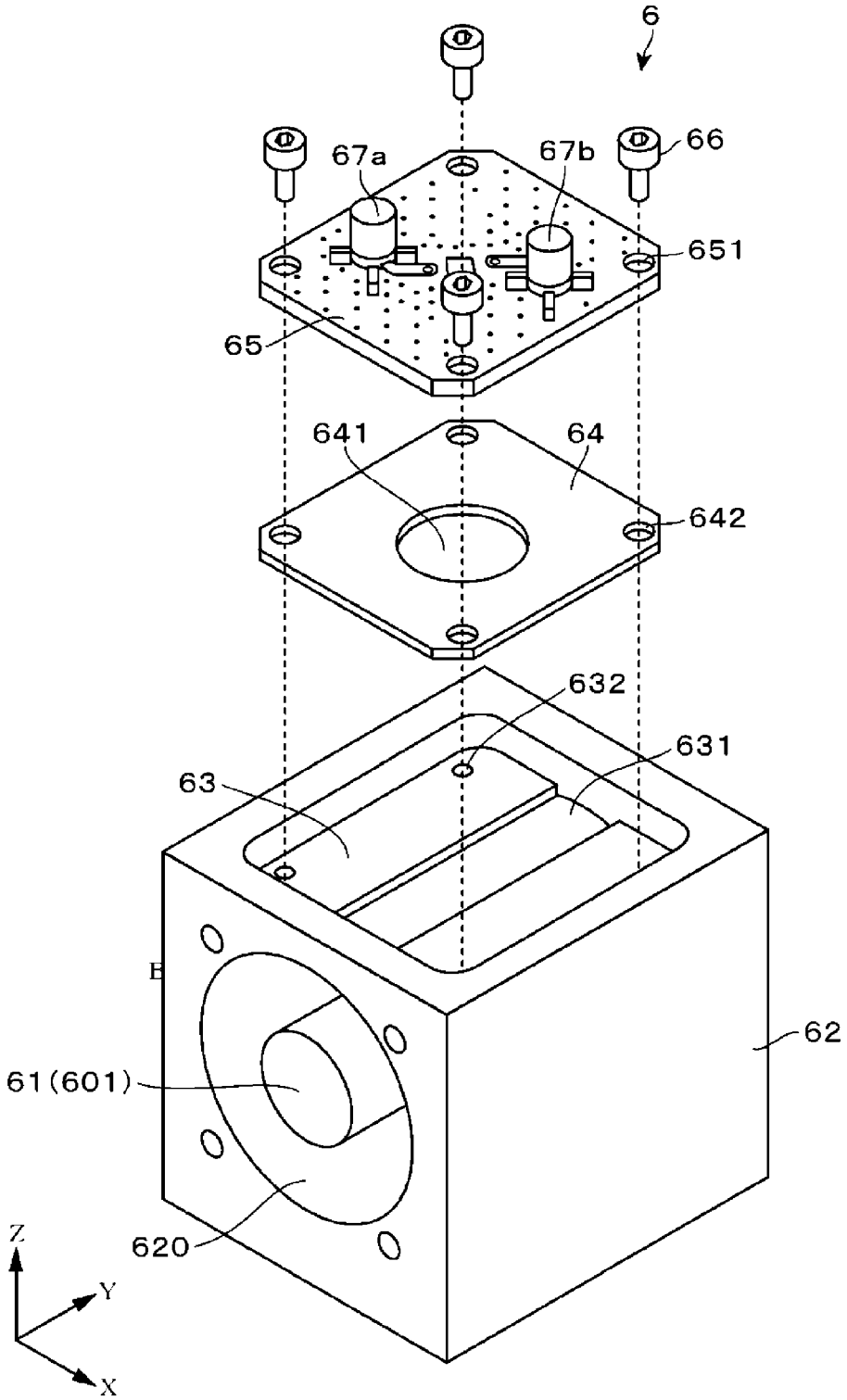
FIG. 5 is an exploded perspective view of the directional coupler of the present disclosure.
Figure 6:
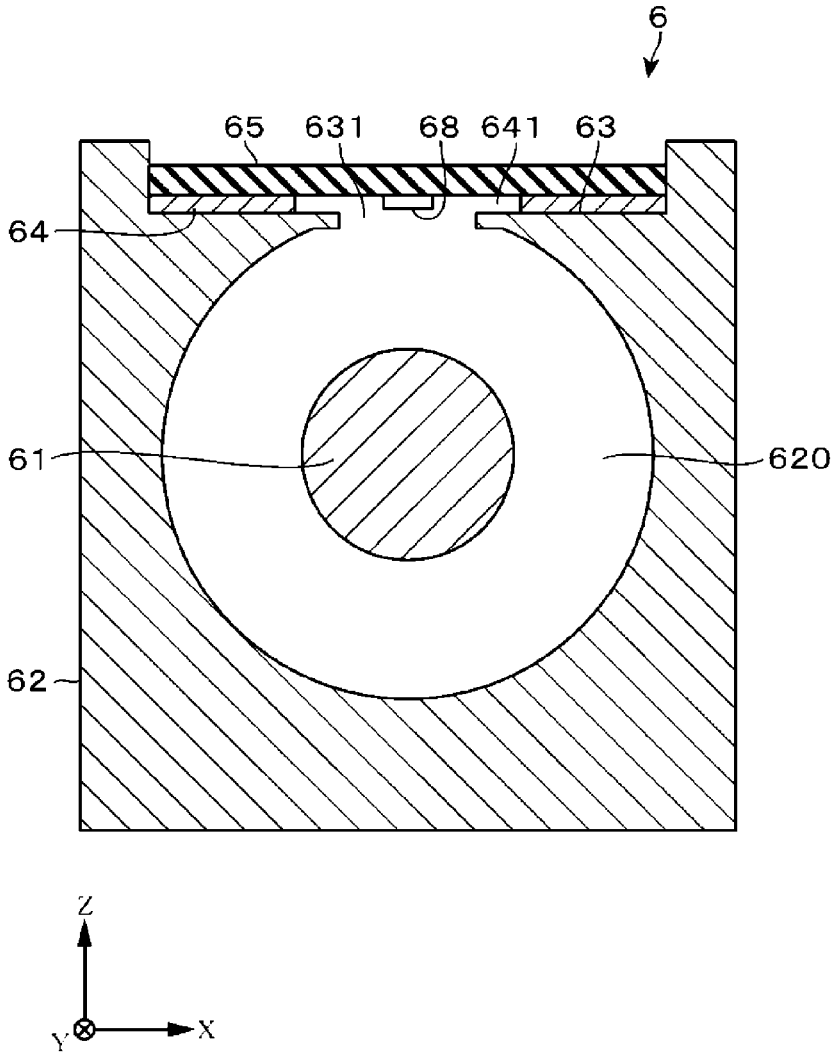
FIG. 6 is a first vertical cross-sectional view of the directional coupler.
Figure 7:
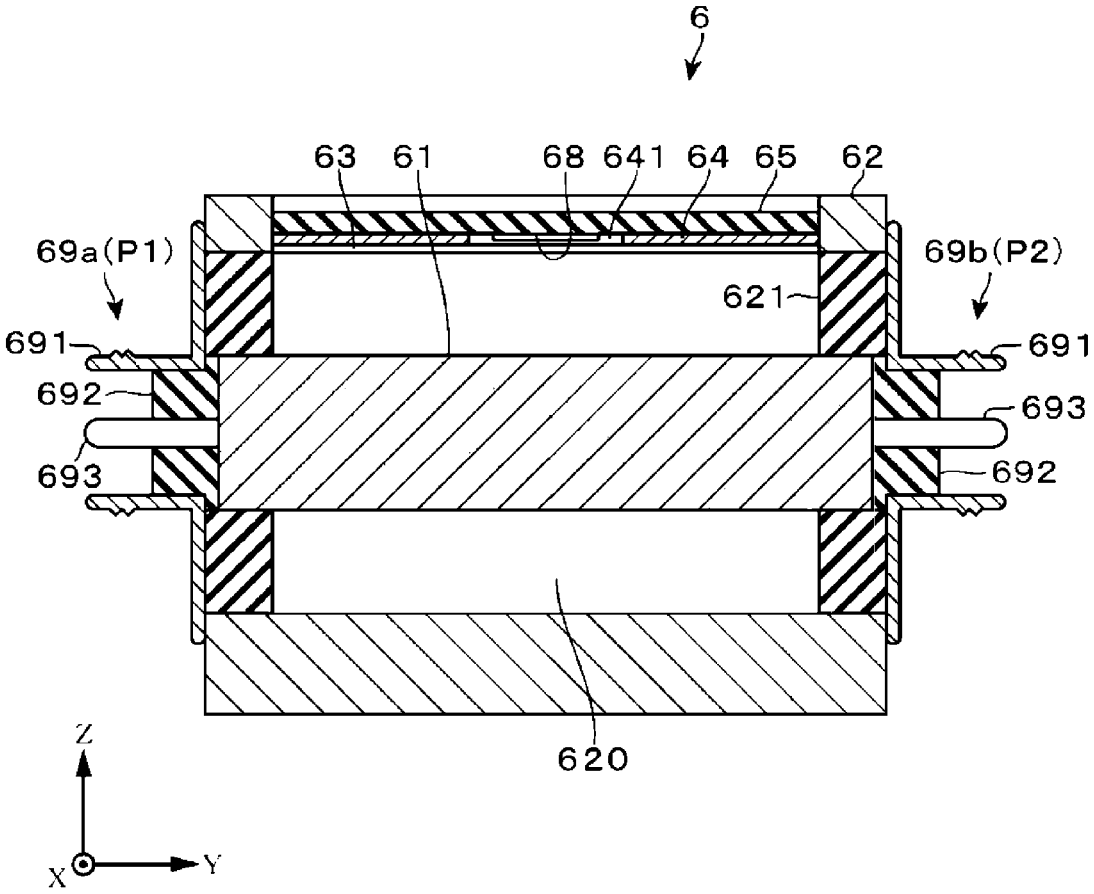
FIG. 7 is a second vertical cross-sectional view of the directional coupler.

The configuration of the directional coupler 6 according to the present embodiment will be described with reference to FIGS. 5 to 7. FIG. 5 is an exploded perspective view of the directional coupler 6, FIG. 6 is a vertical cross-sectional view of the directional coupler 6 when viewed from a front side, FIG. 7 is a vertical cross-sectional view of the directional coupler 6 when viewed from a lateral side. In the following description, sides of the base end and tip end of the Y-axis arrow of the X-Y-Z coordinate system indicated in FIG. 5 are also referred to as a front side and a rear side, respectively.

As illustrated in FIG. 5, the directional coupler 6 of the present embodiment includes a hollow coaxial line composed of the central conductor 61 forming the main line 601 and an outer conductor 62 provided to surround the central conductor 61, a dielectric substrate 65 provided with the coupling line 68 forming the auxiliary line 602, and a metallic spacer 64 for adjusting a distance between the central conductor 61 and the coupling line 68.

As illustrated in FIG. 5, the outer conductor 62 is configured by, for example, a rectangular parallelepiped housing formed of a conductive metal. A cylindrical space (a cylindrical space 620) into which the central conductor 61 can be inserted is formed in a region extending from a front side surface to a rear side surface of the outer conductor 62.

In addition, a recess capable of accommodating the metallic spacer 64 and the dielectric substrate 65 is formed in a top surface of the outer conductor 62. A bottom surface in the recess is flat, and the dielectric substrate 65 is mounted on the flat surface, with a circular opening 641 interposed therebetween. From this point of view, the flat surface in the recess corresponds to a substrate-mounting portion 63 of the present embodiment.

The substrate-mounting portion 63 has a rectangular square opening 631 that is open toward the cylindrical space 620 when viewed from above. A long side direction of the square opening 631 corresponds to a transmission direction of the microwaves. For example, in the case of microwaves of 860 MHz, a length of the square opening 631 in the long side direction is set to be, for example, $\lambda_0/10$ with respect to a free space wavelength $\lambda_0$ of the microwaves. Here, $\lambda_0$ is calculated from a frequency of the microwaves f [Hz] and the speed of light $c_0$ [m/s] by using Equation (6) as follows.

$$\lambda_0=c_0/f\ [m] \quad (6)$$

Here, 'm' is a meter as a unit length of the free space wavelength $\lambda_0$.

As illustrated in FIG. 5, the central conductor 61 is configured by, for example, a round bar-shaped member (rod-shaped conductor) formed of a conductive metal. As illustrated in FIG. 6, a diameter of the central conductor 61 is smaller than a diameter of the cylindrical space 620 formed on the side of the outer conductor 62. The central conductor 61 is inserted into the cylindrical space 620 and is arranged such that positions of central axes of both the central conductor 61 and the cylindrical space 620 are aligned.

As illustrated in FIG. 7, the central conductor 61 is held by insulating members 621, which are provided so as to be fitted into openings formed in both the front and rear surfaces of the outer conductor 62, respectively. An input side coaxial connector (input terminal) 69*a* and an output side coaxial connector (output terminal) 69*b*, each of which is composed of a tubular outer peripheral conductor portion 691, a pin-shaped central conductor portion 693, and an insulating portion 692, are provided on the front side surface and the rear side surface of the outer conductor 62, respectively.

In each of the connectors 69*a* and 69*b*, the central conductor portion 693 is connected to the central conductor 61, and the outer peripheral conductor portion 691 is connected to the outer conductor 62. The input side coaxial connector 69*a* corresponds to the input port P1 of the directional coupler 6, and is connected to a side of an outlet of the amplifier part 31. In addition, the output side coaxial connector 69*b* corresponds to the output port P2, and is connected to a side of an inlet of the microwave introduction mechanism 32 (see FIG. 2).

As illustrated in FIGS. 5 to 7 FIG. 5, the metallic spacer 64 is configured by a rectangular conductive metallic plate. The metallic spacer 64 is configured to have a size that can be accommodated in the recess formed on the top surface of the outer conductor 62, and the circular opening 641 is formed in the central portion thereof. The circular opening 641 is in communication with the cylindrical space 620 via the square opening 631 formed in the substrate-mounting portion 63 of the outer conductor 62.

The metallic spacer 64 serves to adjust the coupling characteristic of the directional coupler 6 by adjusting the distance between the central conductor 61 and the coupling line 68. For example, the metallic spacer 64 may have a thickness dimension within a range of 0.5 mm to 2 mm depending on the frequency of microwaves or the like.

The dielectric substrate 65 is a rectangular plate formed of, for example, epoxy glass, a fluororesin such as polytetrafluoroethylene (PTFE), and a dielectric material such as alumina. The dielectric substrate 65 is configured to have a size that can be accommodated in the recess formed in the top surface of the outer conductor 62. As illustrated in FIG. 6, the dielectric substrate 65 is arranged on the substrate-mounting portion 63 (on the metallic spacer 64) to cover the square opening 631 and the circular opening 641 described above (see FIG. 10).

As illustrated in FIG. 5, the metallic spacer 64 and the dielectric substrate 65 are provided with screw holes 642 and 651, respectively, at a plurality of locations. By inserting substrate-fixing screws 66 into the screw holes 642 and 651 and screw-coupling the substrate-fixing screws 66 to female screws 632 provided in the substrate-mounting portion 63, the metallic spacer 64 and the dielectric substrate 65 are fastened to the substrate-mounting portion 63.

Hereinafter, in the above-described arrangement state, a surface (bottom surface) of the dielectric substrate 65 facing the central conductor 61 via the circular opening 641 and the square opening 631 is referred to as a "rear surface" of the dielectric substrate 65, and an opposite surface (top surface) thereof is referred to as a "front surface" of the dielectric substrate 65.

Figure 8:
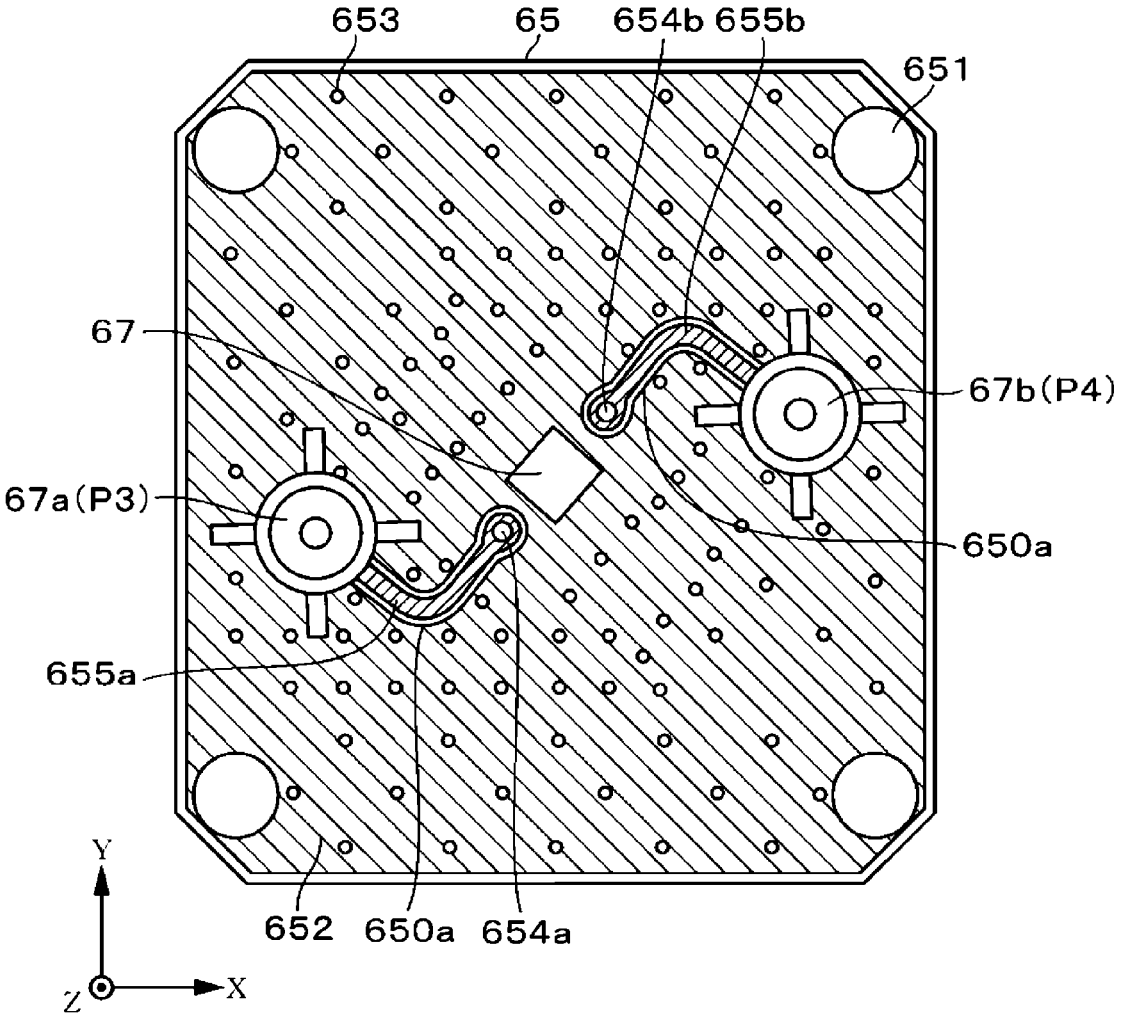
FIG. 8 is a plan view of a front surface of a dielectric substrate provided in the directional coupler.
Figure 9:
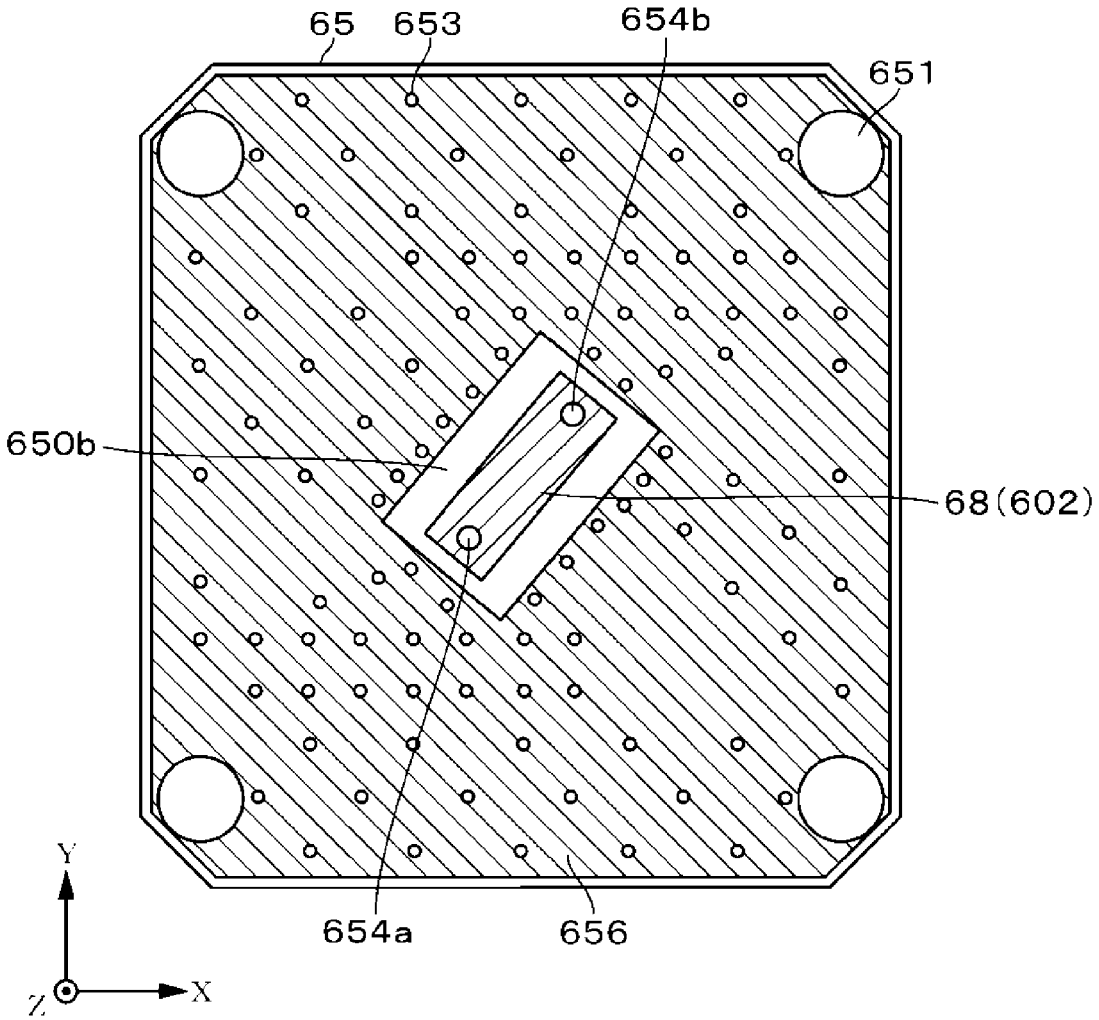
FIG. 9 is a plan view of a rear surface of the dielectric substrate (a projection viewed from above).

Film-shaped ground conductors (a front surface conductor (a ground conductor on the side of the front surface) 652 (see FIG. 8) and a rear surface conductor (a ground conductor on the side of the rear surface) 656 (see FIG. 9)) formed of, for example, a copper foil are provided on the front surface and the rear surface of the dielectric substrate 65, respectively. Here, FIG. 8 is a plan view of the front surface of the dielectric substrate 65 viewed from above, and FIG. 9 is a plan view of the rear surface of the dielectric substrate 65 viewed through the dielectric substrate 65 from above.

The front surface conductor 652 and the rear surface conductor 656 are arranged so as to cover the substantially entirety of both the front and rear surfaces of the dielectric substrate 65. As illustrated in FIG. 8, a large number of through-holes 653 are distributedly formed over the plate surface of the dielectric substrate 65. The front surface conductor 652 and the rear surface conductor 656 are electrically connected to each other via connecting lines (not illustrated) formed along the respective through-holes 653. In addition, by connecting one or both of the front surface conductor 652 and the rear surface conductor 656 to the outer conductor 62 via the substrate-fixing screws 66 (FIG. 5), both the front surface conductor 652 and the rear surface conductor 656 are grounded. The outer conductor 62 is grounded via a ground line (not illustrated).

Next, a configuration of the rear surface of the dielectric substrate 65 will be described first with reference to FIG. 9. In a central portion of the rear surface of the dielectric substrate 65, the coupling line 68 is provided at a location facing the central conductor 61 in the cylindrical space 620 via the above-described square opening 631 and circular opening 641. As described above, the coupling line 68 corresponds to the auxiliary line 602 of the directional coupler 6 of the present embodiment.

The coupling line 68 is configured by, for example, a copper foil as a conductor film. For example, the coupling line 68 may be formed by forming a copper foil on the entirety of the rear surface of the dielectric substrate 65 by plating, and then removing a portion of the copper foil around the coupling line 68 by etching to provide a separation region 650*b* between the rear surface conductor 656 and the coupling line 68. Therefore, the coupling line 68 is in an electrically non-conductive state with (a state of not being electrically connected to) the rear surface conductor 656.

As illustrated in FIG. 9, in the present embodiment, the coupling line 68 is formed in an elongated strip shape. For example, in the case of using microwaves of 860 MHz, a length of the coupling line 68 in the long side direction is set to $\lambda_g/4$ or less, specifically, $\lambda_g/20$ or less, with respect to a wavelength $\lambda_g$ of the microwaves on the dielectric substrate 65. Here, $\lambda_g$ is calculated by using the following Equation (7), based on the above-mentioned free space wavelength $\lambda_0$ of the microwaves and an effective dielectric constant $\varepsilon_{eff}$ of the dielectric substrate 65.

$$\lambda_g=\lambda_0/(\varepsilon_{eff})^{0.5}\ [m] \tag{7}$$

Here, 'm' is a meter as a unit length of the wavelength $\lambda_g$.

In addition, $\varepsilon_{eff}$ can be obtained from, for example, formulas described in a literature (T. C. Edwards, M. B. Steer, Foundations for Microstrip Circuit Design, $4_{th}$ Edition, pp. 127-134, John Wiley & Sons, Inc., 2016).

Figure 10:
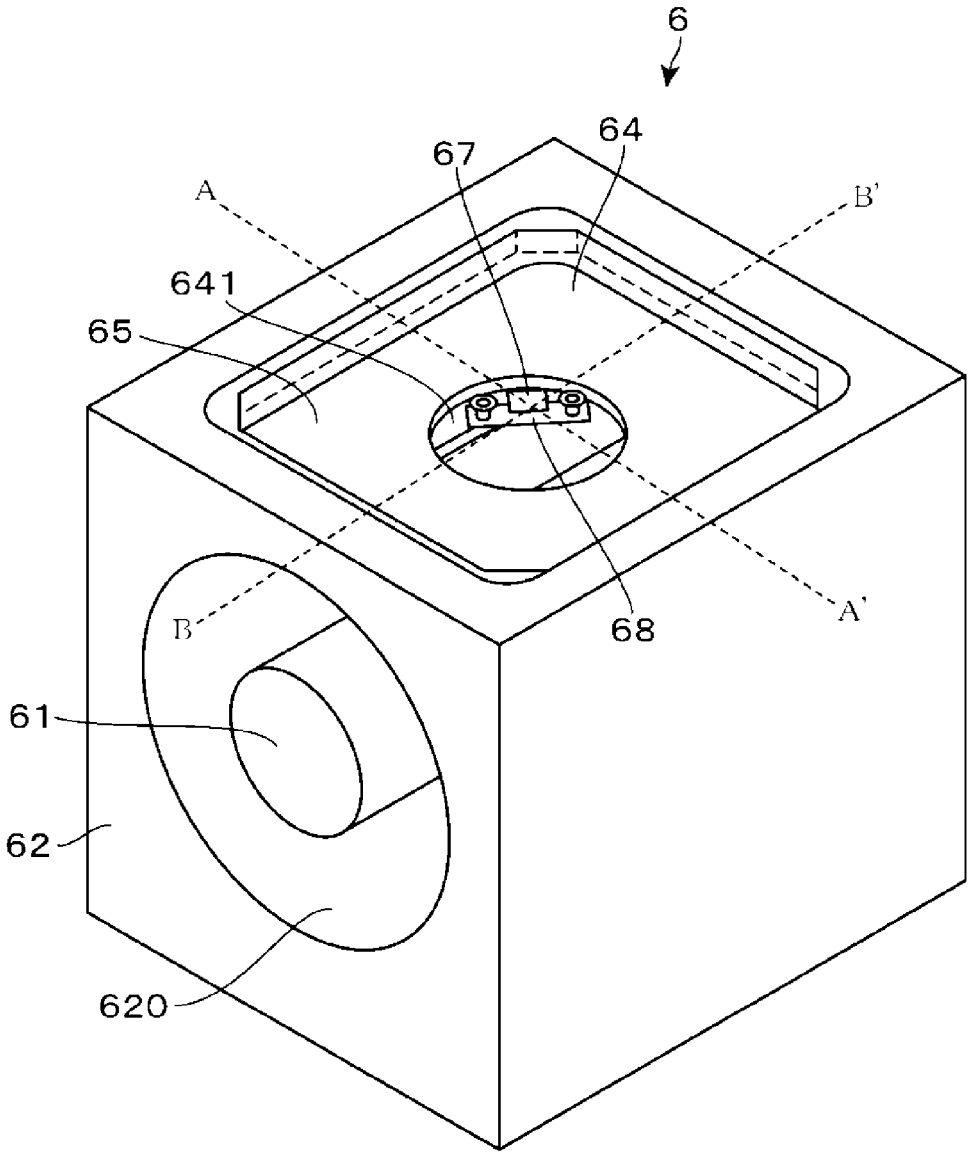
FIG. 10 is a perspective view of an external appearance of the directional coupler.
Figure 11:
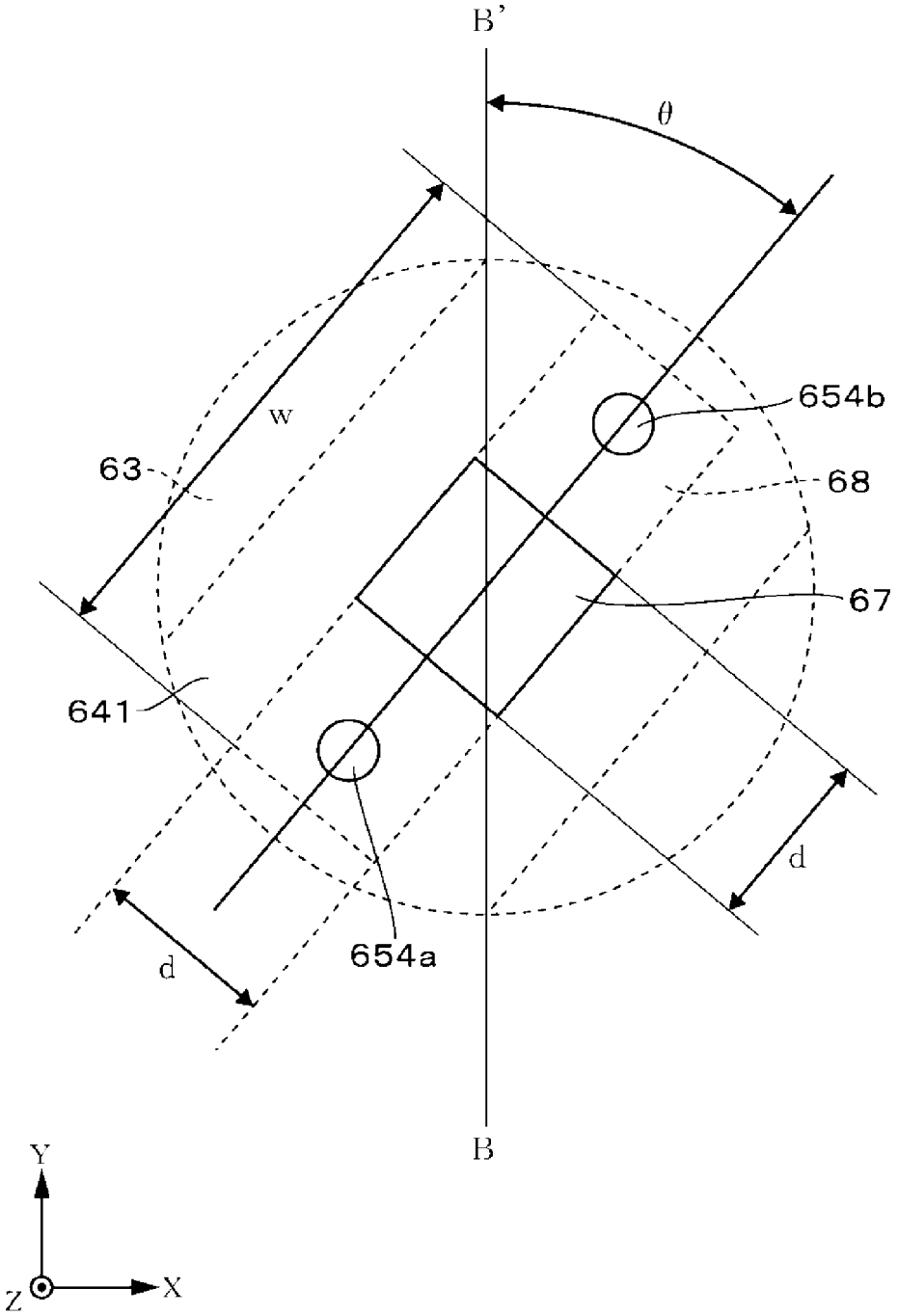
FIG. 11 is an enlarged plan view of a coupling line.

As illustrated in FIGS. 10 and 11, dimensions in the long side direction w and a short side direction d of the coupling line 68 as shown in FIG. 11 are set such that the coupling line 68 is included in an opening region formed by overlapping the square opening 631 in the substrate-mounting portion 63 with the circular opening 641 in the metallic spacer 64. For convenience of illustration, FIGS. 10 and 11 illustrate states seen through a dielectric main body, the front surface conductor 652, the rear surface conductor 656 of the dielectric substrate 65, and the like.

FIG. 11 shows an arrangement direction of the coupling line 68 when viewed from above, which is opposite to the surface of the coupling line 68. Line B-B' in FIG. 11 coincides with an extending direction of the central conductor 61 arranged inside the outer conductor 62 while line A-A' is orthogonal to the line B-B' as shown in FIG. 10. As illustrated in FIG. 11, the coupling line 68 is arranged such that an extending direction of the elongated strip-shaped coupling line 68 and the extending direction of the central conductor 61 (the direction of line B-B' in FIG. 11) intersect with each other at an angle θ when viewed from above. As illustrated in Examples to be described later, the intersection angle θ is a parameter that affects the directional characteristic of the directional coupler 6. In the case of using the microwaves of 860 MHz, the intersection angle θ is set to be, for example, a preset angle within a range of 39±2 degrees.

The above-mentioned intersection angle θ may be set when designing the coupling line 68 on the rear surface of the dielectric substrate 65. In addition, the intersection angle θ may be adjusted by changing a mounting direction of the dielectric substrate 65 with respect to the outer conductor 62 when viewed from above.

Figure 13:
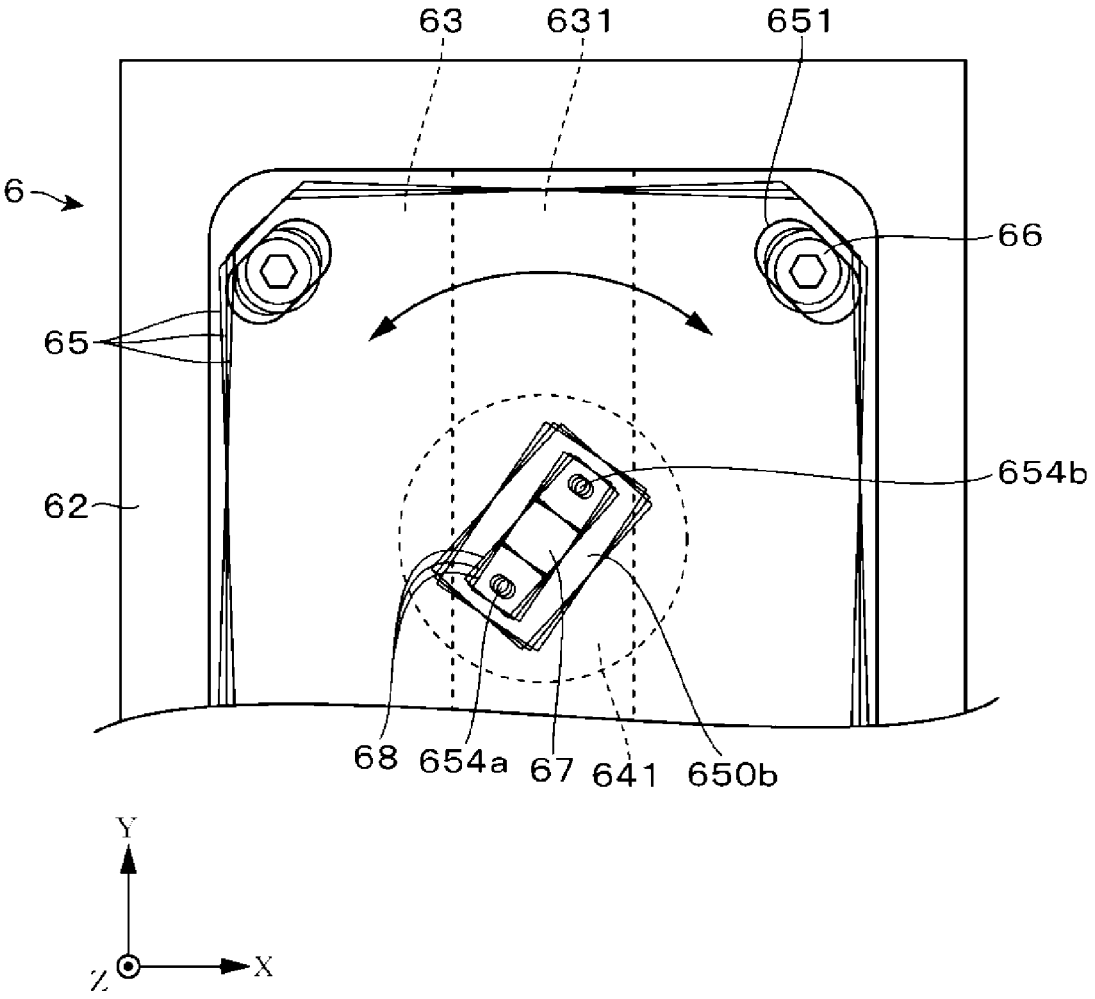
FIG. 13 is a plan view illustrating an operation of an angle adjustment mechanism for adjusting an orientation of the coupling line.

FIG. 13 illustrates an exemplary configuration of an angle adjustment mechanism for adjusting the mounting direction of the dielectric substrate 65. The angle adjustment mechanism of the present embodiment is composed of the substrate-fixing screws 66 for attaching the dielectric substrate 65 to the substrate-mounting portion 63, and the screw holes 651 formed to be wider than the diameter of the substrate-fixing screws 66 in an angle adjustment direction of the dielectric substrate 65. By forming the screw holes 651 to have enough room with respect to the diameter of the substrate-fixing screws 66 and changing the mounting direction of the dielectric substrate 65 as illustrated in FIG. 13, it is possible to adjust the intersection angle θ described above with reference to FIG. 11.

As schematically illustrated in FIG. 7, the coupling line 68 is formed on the flat rear surface of the dielectric substrate 65 as a plate member. With this configuration, when viewed from a direction along the surface of the dielectric substrate 65 as illustrated in FIG. 7, the extending direction of the central conductor 61 and the extending direction of the coupling line 68 are aligned (substantially parallel to each other).

Next, a configuration on a side of the front surface of the dielectric substrate 65 will be described with reference to FIG. 8. As illustrated in FIG. 8, on the front surface of the dielectric substrate 65, a coaxial connector 67*a* for traveling waves (a traveling wave extraction terminal) configured to extract a portion of the traveling waves of the microwaves via the coupling line 68 (FIG. 9), and a coaxial connector 67*b* for reflected waves (a reflected wave extraction terminal) configured to extract a portion of the reflected waves of the microwaves are provided.

In comparison with the directional coupler 60 described above with reference to FIG. 4, the coaxial connector 67*a* for traveling waves corresponds to the coupling port P3 of the directional coupler 6, and the coaxial connector 67*b* for reflected waves corresponds to the isolation port P4 of the directional coupler 6. For example, each of the connectors 67*a* and 67*b* is connected to a signal line that outputs a portion of the microwaves as a high-frequency signal toward the power controller 316 (see FIG. 3).

The coaxial connector 67*a* for traveling waves and the coaxial connector 67*b* for reflected waves are connected to one end of an extraction line 655*a* and one end of an extraction line 655*b*, which are formed on the side of the front surface of the dielectric substrate 65, respectively. Each of the extraction lines 655*a* and 655*b* is formed with a gap with respect to the front surface conductor 652 via a separation region 650*a*. The extraction lines 655*a* and 655*b* may be formed, for example, by forming a copper foil on the entirety of the front surface of the dielectric substrate 65 by plating, and then removing portions of the copper foil around the extraction lines 655*a* and 655*b* by etching, respectively, to provide the separation regions 650*a* between the front surface conductor 652 and the extraction line 655*a* and between the front surface conductor 652 and the extraction line 655*b*.

Here, each of the extraction lines 655*a* and 655*b* constitutes a grounded coplanar line having a characteristic impedance of 50Ω between the front surface conductor 652, which is provided in regions on both sides of the extraction lines 655*a* and 655*b*, and the rear surface conductor 656.

It is not an essential requirement to configure the extraction lines 655*a* and 655*b* as grounded coplanar lines. For example, the width of the separation regions 650*a* may be increased to such an extent that the effect of the electromagnetic field of the front surface conductor 652 becomes sufficiently small by further cutting out portions of the front surface conductor 652 in the regions on both sides of the extraction lines 655*a* and 655*b*. However, the width of the separation regions 650*a* in this case needs to be equal to or greater than a thickness of the dielectric substrate 65, whereby each of the extraction lines 655*a* and 655*b* constitutes a microstrip line with the rear surface conductor 656.

The other ends of the extraction lines 655*a* and 655*b* extend to locations corresponding to opposite ends of the coupling line 68 in the long side direction, respectively, and are connected to the coupling line 68 on the rear surface via through holes 654*a* and 654*b* formed in the dielectric substrate 65 at the above-described locations, respectively.

In the directional coupler 6 having the configuration described above, when the microwaves are supplied from the input side coaxial connector 69*a* as the input port P1, and output from the output side coaxial connector 69*b* as the output port P2, the central conductor 61 as the main line 601 and the coupling line 68 as the auxiliary line 602 are electromagnetically coupled to each other. As a result, a portion of the traveling waves of the microwaves can be extracted as a high-frequency signal from the coaxial connector 67*a* for traveling waves, which is the coupling port P3. In addition, a portion of the reflected waves of the microwaves can be extracted as a high-frequency signal from the coaxial connector 67*b* for reflected waves, which is the isolation port P4.

With respect to the above-described problem in which it is difficult to improve the directional characteristic when the electromagnetic field coupling state between the central conductor 61 and the coupling line 68 is a loosely-coupled state, the directional coupler 6 of the present embodiment improves the directional characteristic by providing the following configurations.

Figure 12:
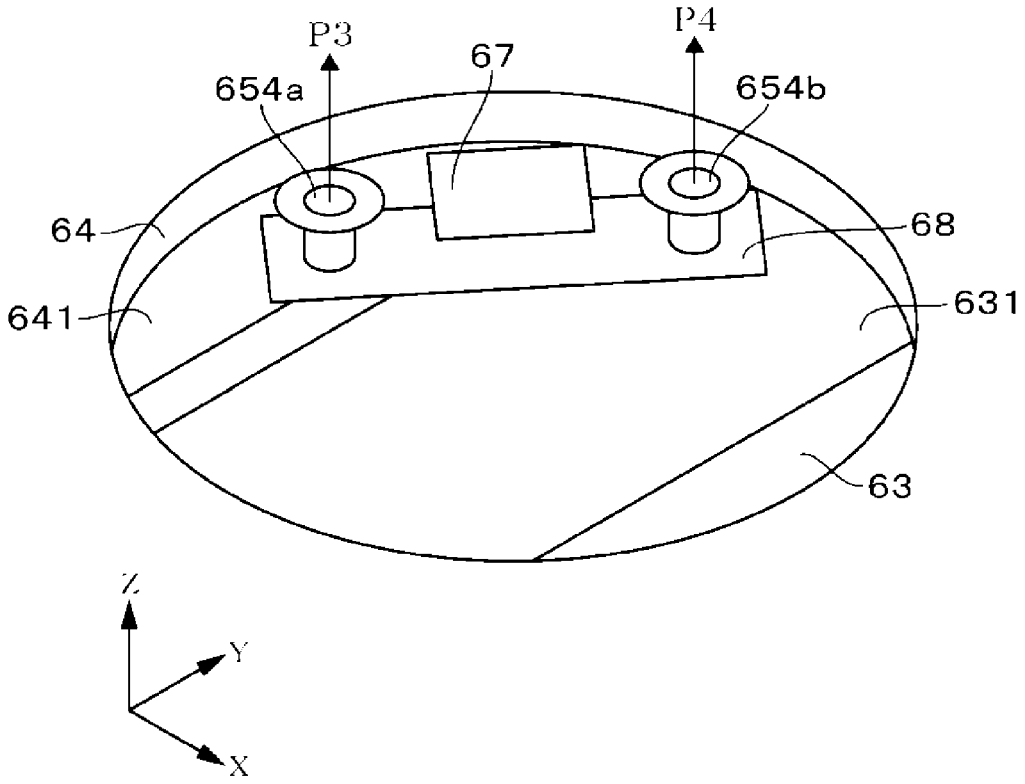
FIG. 12 is an enlarged perspective view of the coupling line provided on the dielectric substrate.

That is, as illustrated in FIG. 12, in the directional coupler 6 of the present embodiment, the front surface conductor 652 is provided with a conductor-removed portion (a non-conductive region) 67 in which a portion of the copper foil (a conductor film) in a region (a counterpart region) facing the coupling line 68 via the dielectric substrate 65 is removed. The perspective view of FIG. 12 illustrates a state viewed through the dielectric substrate 65, the front surface conductor 652, and the rear surface conductor 656, other than the counterpart region.

Figure 14:
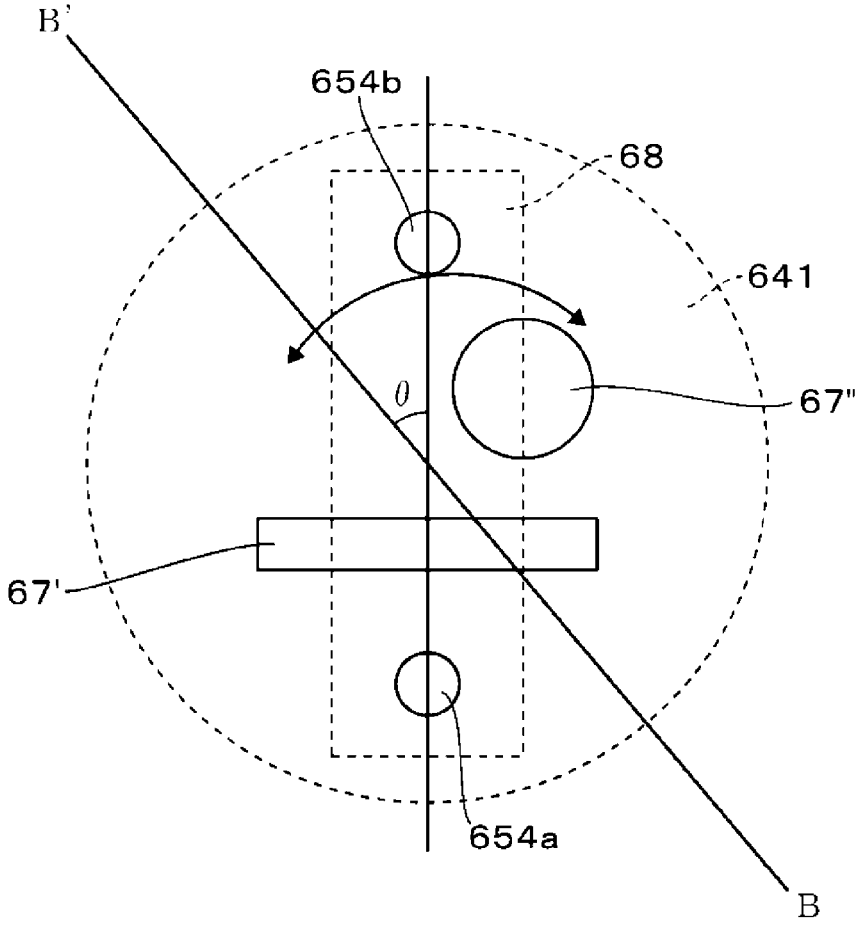
FIG. 14 is a plan view illustrating a variation of a conductor-removed portion.

A shape of the conductor-removed portion 67 is not particularly limited. For example, the square conductor-removed portion 67 may be provided as illustrated in FIG. 11, or a rectangular or circular conductor-removed portion 67' or 67" may be provided as illustrated in FIG. 14. In addition, the number of conductor-removed portions 67 formed on the front surface conductor 652 is not limited to one, and a plurality of conductor-removed portions 67 may be provided.

In addition, as long as a part of each of the front surface conductor 652 and the conductor-removed portion 67 is left in the counterpart region, there is no particular limitation on dimensions of the conductor-removed portion 67.

As illustrated in examples to be described later, compared with a directional coupler according to a comparative example in which the conductor-removed portion 67 is not provided, it has been confirmed through simulations and tests that directional characteristic is improved by providing the conductor-removed portion 67 on the front surface conductor 652.

The dimensions, shapes, arrangement number, and arrangement positions of conductor-removed portions 67 are determined by combining the dimensions, shapes, arrangement number, and arrangement positions with other design parameters such as the opening length of the square opening 631, the opening diameter of the circular opening 641, the length of the coupling line 68 in the long side direction, and the intersection angle θ, and searching for conditions that can exhibit suitable directional characteristics through simulations and trial tests.

Next, an exemplary configuration of a directional coupler 6*a* according to a second embodiment will be described.

Figure 15:
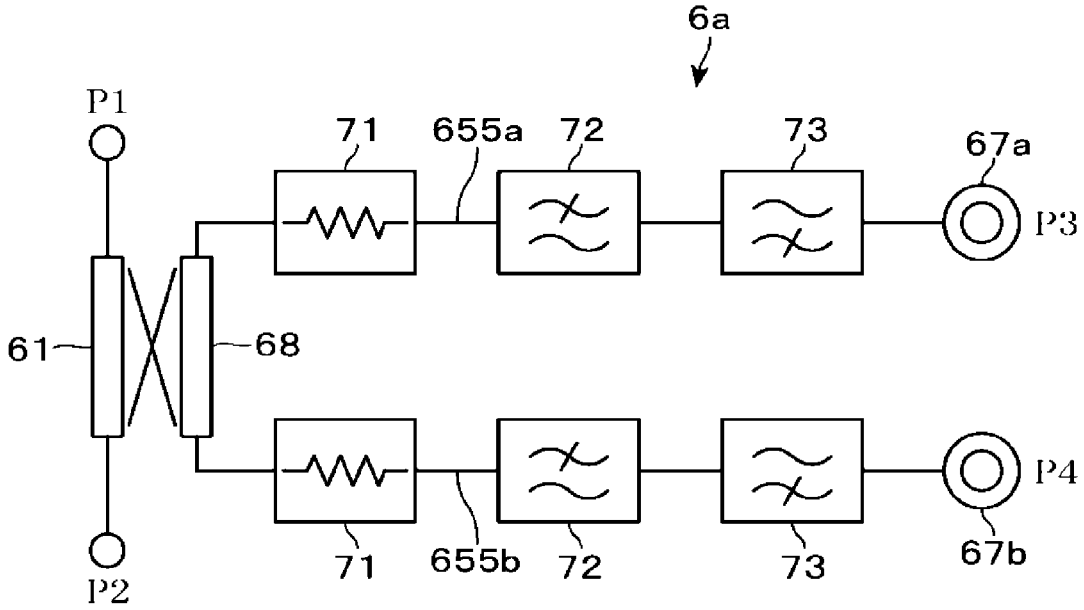
FIG. 15 is a view illustrating a configuration of a directional coupler according to a second embodiment.

In the directional coupler 6*a* according to the second embodiment illustrated in FIG. 15, elements that perform a wave processing on microwaves to be extracted are provided in the extraction line 655*a* from the coupling line 68 to the coaxial connector 67*a* for traveling waves and in the extraction line 655*b* from the coupling line 68 to the coaxial connector 67*b* for reflected microwaves. As the elements provided in the extraction lines 655*a* and 655*b*, at least one element selected from a group including a low-pass filter (LPF) 72 configured to suppress high-frequency components included in the high-frequency signals extracted via the coupling line 68, a high-pass filter (HPF) 73 configured to suppress low-frequency components, and an attenuator 71 configured to attenuate reflected waves from the side of the coaxial connector 67*a* for traveling waves or from the side of the coaxial connector 67*b* for reflected waves is provided. The LPF72 and HPF73 may be configured by band-pass filters (BPFs) having the same frequency characteristics.

Figure 16:
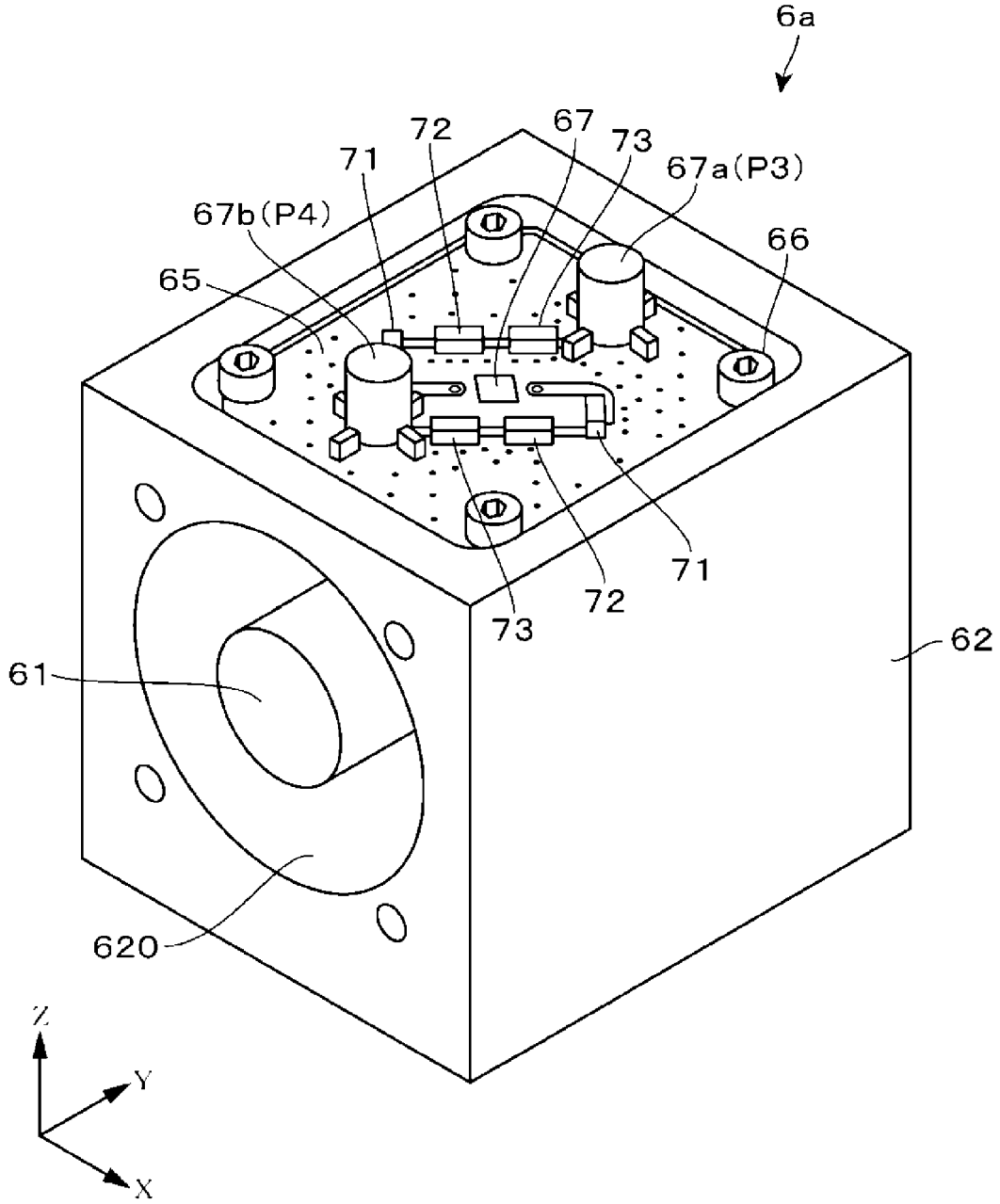
FIG. 16 is a perspective view of an external appearance of the directional coupler according to the second embodiment.
Figure 17:
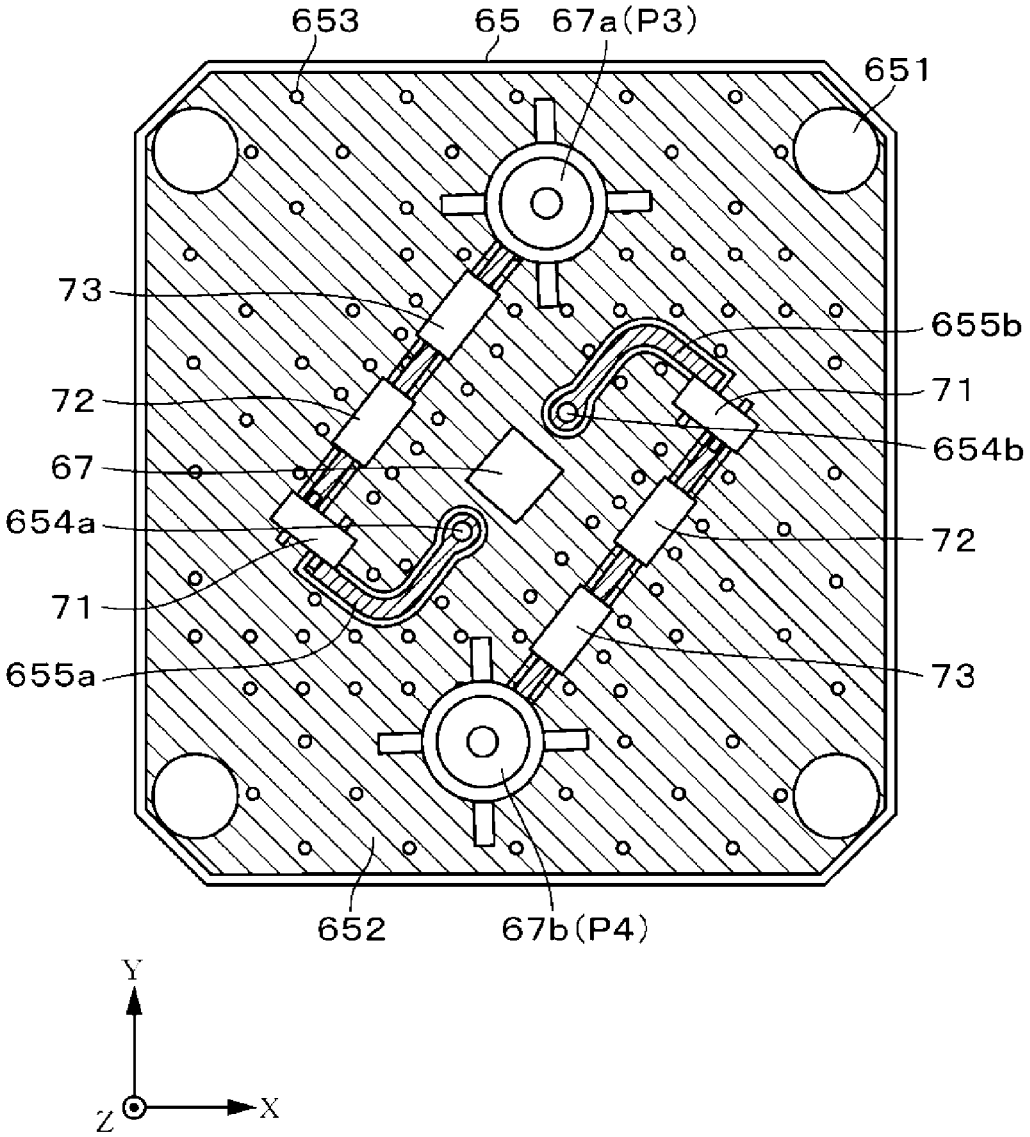
FIG. 17 is a plan view of a front surface of the dielectric substrate according to the second embodiment.

In the exemplary directional coupler 6*a* illustrated in FIG. 15, the attenuators 71, the LPF 72, and the HPF 73 are provided for the extraction lines 655*a* and 655*b* in this order from the side of the coupling line 68 to the sides of the connectors 67*a* and 67*b*, respectively. As illustrated in FIG. 16, these elements (attenuator 71, LPF 72, and HPF 73) may be arranged on side of the front surface of the dielectric substrate 65. Combination of the elements provided on the extraction lines 655*a* and 655*b* is not limited to the above-described example, and may be appropriately selected depending on the purpose of use of the high-frequency signals and the like.

According to the present disclosure, it is possible to configure the directional coupler 6 or 6*a* having a good directional characteristic while loosely coupling the coupling line 68 as the auxiliary line 602 to the central conductor 61 as the main line 601.

Here, FIGS. 11 and 12 illustrate an example in which the diameter of the circular opening 641 formed in the metallic spacer 64 is larger than the dimension of the square opening 631 formed in the substrate-mounting portion 63 in the short side direction. However, a magnitude relationship between these dimensions is not limited to the example illustrated in FIGS. 11 and 12.

The diameter of the circular opening 641 formed in the metallic spacer 64 may be smaller than the dimension of the square opening 631 formed in the substrate-mounting portion 63 in the short side direction. In this case, the shape of the opening viewed from above (the shape in which the square opening 631 formed in the substrate-mounting portion 63 and the circular opening 641 formed in the metallic spacer 64 overlap each other) is circular. It is not an essential requirement to dispose the metallic spacer 64 between the substrate-mounting portion 63 and the dielectric substrate 65, and the dielectric substrate 65 may be disposed directly on the substrate-mounting portion 63. In this case, the substrate-mounting portion 63 may be provided with a circular opening.

For example, when the coupling line 68 is arranged so as to face the central conductor 61 via the circular opening 641 as illustrated in FIG. 14, the distance from each location on the coupling line 68 to the periphery of the circular opening 641 does not change even if the intersection angle θ is changed by using the angle adjustment mechanism described above with reference to FIG. 13. As a result, it is possible to suppress an unintended change in the characteristics of the directional coupler 6 or 6*a*, which may be caused due to a change in interaction between the coupling line 68 and the dielectric substrate 65 or between the coupling line 68 and the metallic spacer 64 when the intersection angle θ is changed.

In addition, the dielectric substrate 65 is not limited to be configured using a two-layer substrate in which ground conductors (the front surface conductor 652 and the rear surface conductor 656) are formed only on both the front and rear surfaces of the dielectric substrate 65. The dielectric substrate 65 may be configured using a multilayer substrate having three or more layers, in which one or more layers of ground conductors are inserted in the dielectric substrate 65 in addition to the ground conductors on both the front and rear surfaces thereof.

The installation position of the directional coupler 6 or 6*a* described above is not limited to the location between the amplifier part 31 and the microwave introduction mechanism 32 as described above with reference to FIG. 2. The directional coupler 6 or 6*a* may be provided at a required position in the microwave supply path from the microwave oscillator 332 (FIG. 2) as a microwave supplier to a region below the microwave transmission window 324 (FIG. 1) as the plasma forming part. For example, by providing the directional coupler 6 or 6*a* such that the inner conductor 325 of the microwave introduction mechanism 32 serves as the central conductor 61, a portion of microwaves flowing through the microwave introduction mechanism 32 may be extracted.

It should be understood that the embodiments disclosed herein are illustrative and are not limiting in all aspects. The above-described embodiments may be omitted, replaced, or modified in various forms without departing from the scope and spirit of the appended claims.

EXAMPLES (Simulation 1)

A simulation model based on the directional coupler 6 illustrated in FIG. 7 was fabricated, and evaluation indices of the directional coupler 6 were obtained.

A. Simulation Condition

A central conductor 61 having a diameter of 12 mm and a length of 43 mm was disposed in an outer conductor 62 in which a cylindrical space 620 having a diameter of 28 mm was formed, and a dielectric substrate 65 was provided on a substrate-mounting portion 63, in which a square opening 631 having a length of 33 mm in the long side direction was formed, with a metallic spacer 64, in which a circular opening 641 having a diameter of 26 mm is formed, being interposed therebetween. The length of the coupling line 68 in the long side direction was 8 mm, and the length thereof in the short side direction was 2.6 mm. The thickness of the metallic spacer 64 was 1.5 mm, and the height distance between the central conductor 61 and the coupling line 68 was 15.5 mm from the center of the central conductor 61. The intersection angle θ was set to 43 degrees.

As illustrated in FIG. 11, a square conductor-removed portion 67, in which the length of each side (the width of the conductor-removed portion) was d, was provided at a location facing the center of the coupling line 68. In the simulation model of the directional coupler 6 having the configuration described above, a coupling characteristic, an isolation characteristic, and a directional characteristic were obtained by inputting microwaves having a predetermined frequency to the input port P1. Various frequency characteristics were calculated by using a simulator of HFSS (trademark) from ANSYS (registered mark).

Figure 18:
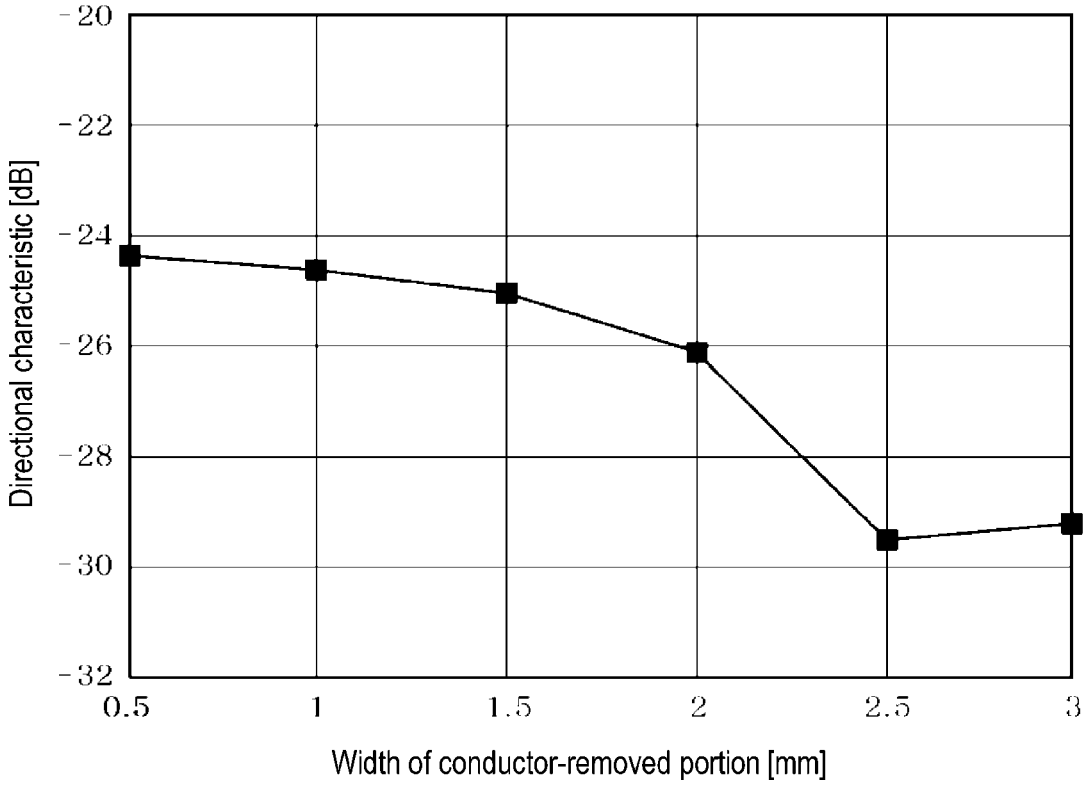
FIG. 18 is a characteristic diagram illustrating a change in directional characteristic with respect to a width of a conductor-removed portion.
Figure 19:
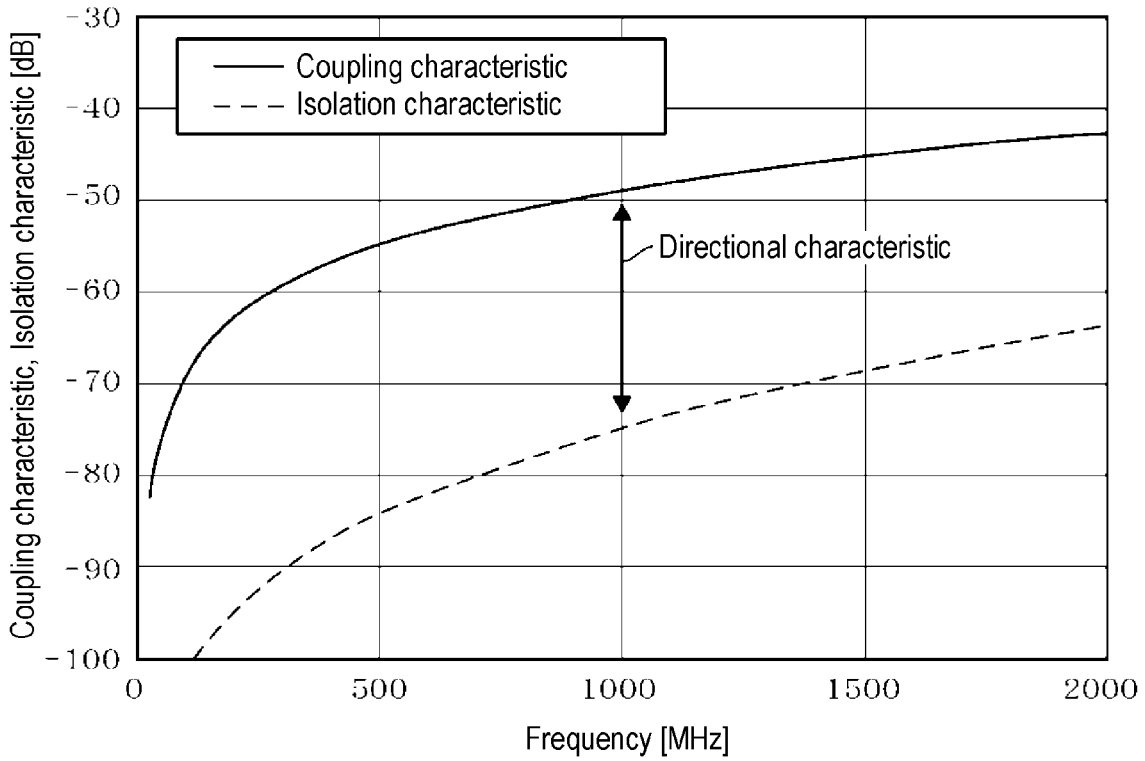
FIG. 19 is an explanatory view of characteristics of the directional coupler.
Figure 20:
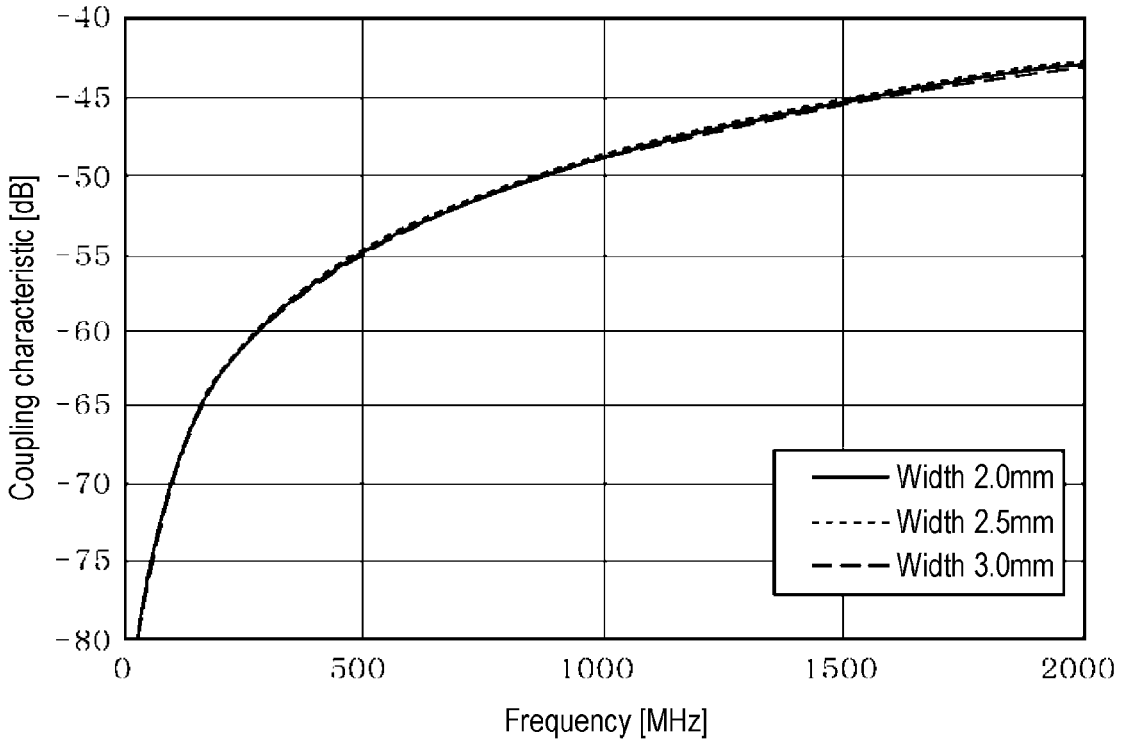
FIG. 20 is a characteristic diagram illustrating a frequency characteristic of a coupling characteristic.
Figure 21:
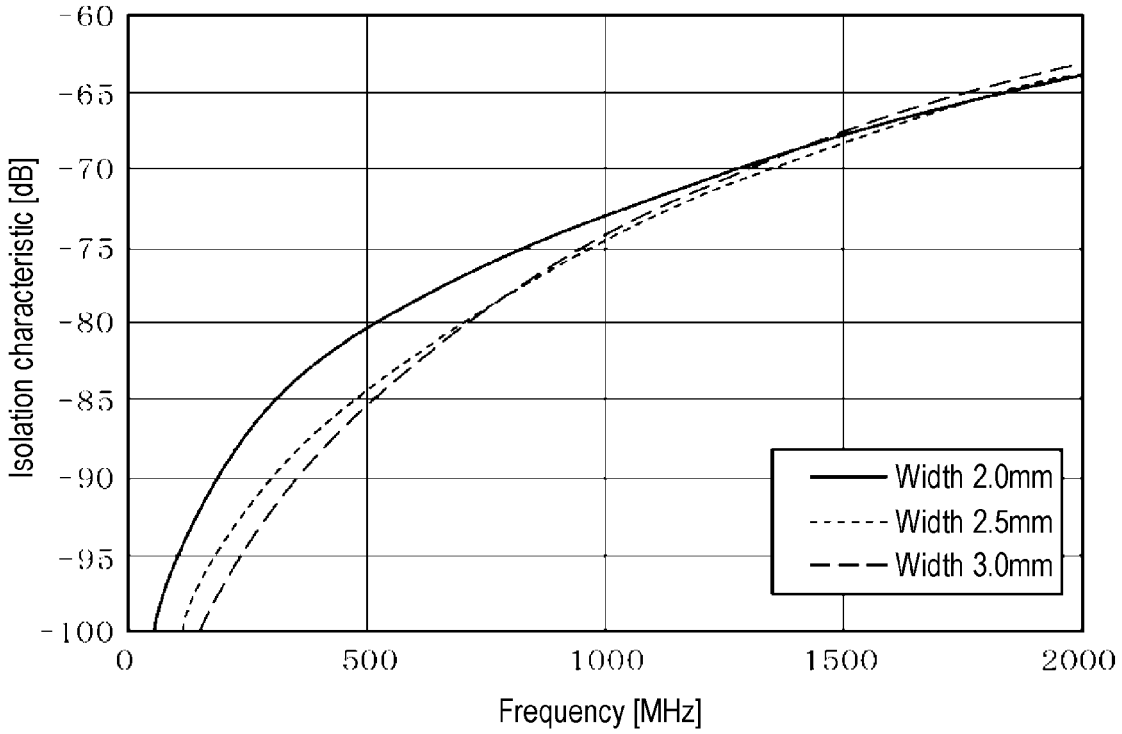
FIG. 21 is a characteristic diagram illustrating a frequency characteristic of an isolation characteristic.
Figure 22:
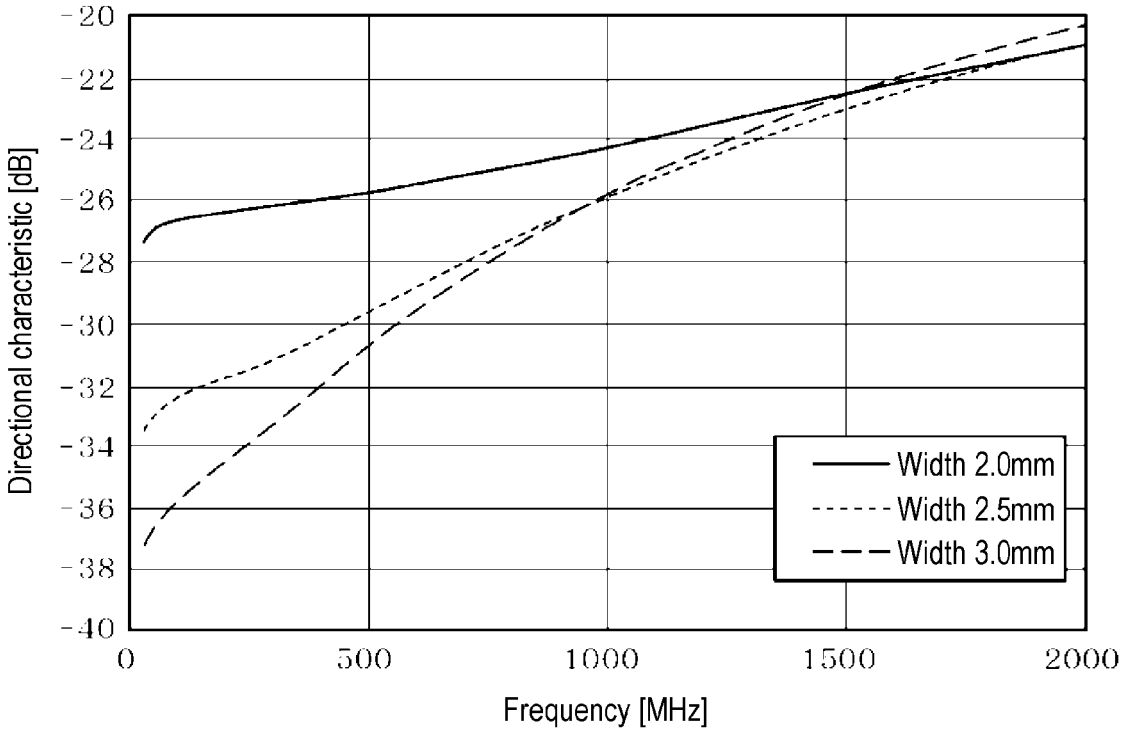
FIG. 22 is a characteristic diagram illustrating a frequency characteristic of a directional characteristic.

(Example 1-1) Width d of conductor-removed portion=0.5 mm (Example 1-2) Width d of conductor-removed portion=1.0 mm (Example 1-3) Width d of conductor-removed portion=1.5 mm (Example 1-4) Width d of conductor-removed portion=2.0 mm (Example 1-5) Width d of conductor-removed portion=2.5 mm (Example 1-6) Width d of conductor-removed portion=3.0 mm B. Simulation Result FIG. 18 shows a change in the directional characteristic dB when microwaves of 860 MHz were supplied to the simulation model of each of Example 1-1 to 1-6. In addition, with respect to Example 1-5, the coupling characteristic and the isolation characteristic (i.e. each in dB) were obtained by changing the frequencies in MHz of the signals supplied to the directional coupler 6, and the result is shown in FIG. 19. In addition, with respect to Examples 1-4 to 1-6, the coupling characteristics in dB obtained by changing the frequencies in MHz of the signals supplied to the directional coupler 6 were compared, and the result is shown in FIG. 20. The isolation characteristics in dB obtained by changing the frequencies in MHz of the signals supplied to the directional coupler 6 were compared, and the result is shown in FIG. 21. The directional characteristics in dB obtained by changing the frequencies in MHz of the signals supplied to the directional coupler 6 were compared, and the result is shown in FIG. 22.

According to the result shown in FIG. 18, as the width d of the conductor-removed portion 67 was increased from 0.5 mm to 2.5 mm, the directional characteristic tends to increase in absolute value (tends to be improved). Meanwhile, when the width of the conductor-removed portion 67 was further increased to 3.0 mm, the directional characteristic deteriorated slightly. According to this simulation result, when microwaves of 860 MHz are supplied and a square conductor-removed portion 67 is provided at a location facing the center of the elongated strip-shaped coupling line 68, it is expected that there exists an optimal width that minimizes the directional characteristic (see Example 1-5).

According to the result shown in FIG. 19, when the frequency of the high-frequency power was changed under the condition of Example 1-5, no steep peak was observed in either the coupling characteristic or the isolation characteristic. According to this result, it can be considered that the directional coupler 6 according to Example 1-5 can exhibit a good directional characteristic over a wide band.

According to the result shown in FIG. 20, it can be recognized that, in Examples 1-4 to 1-6 in which the width d of the conductor-removed portion 67 was changed (i.e. from 2.0 mm to 2.5 mm to 3.0 mm), the coupling characteristic does not depend on the width of the conductor-removed portion 67 and is constant and equivalent among Examples 1-4 to 1-6. On the other hand, according to the result shown in FIG. 21, the isolation characteristic changes among Examples 1-4 to 1-6 in response to the change in the width (i.e. from 2.0 mm to 2.5 mm to 3.0 mm) of the conductor-removed portion 67.

As described above, when the width of the conductor-removed portion 67 is changed, the coupling characteristic is substantially not changed (while maintaining the loosely coupled state), and only the isolation characteristic changes. As a result, as shown in FIG. 22, it can be recognized that the directional characteristic can be improved depending on the width of the conductor-removed portion being changed (i.e. from 2.0 mm to 2.5 mm to 3.0 mm).

(Test 1)

A directional coupler 6 having almost the same configuration as the simulation model set in Simulation 1 was fabricated, and a directional characteristic of the directional coupler 6 was obtained by using a vector network analyzer.

A. Test Condition (Example 2-1) Width d of the conductor-removed portion=2.3 mm, length of the coupling line 68 in short side direction=2.6 mm (Example 2-2) Width d of the conductor-removed portion=2.5 mm, length of the coupling line 68 in short side direction=2.6 mm (Example 2-3) Width d of the conductor-removed portion=2.7 mm, length of the coupling line 68 in short side direction=2.6 mm (Comparative Example 2-1) No conductor-removed portion 67, length of the coupling line 68 in the short side direction=3 mm, intersection angle θ=39 degrees In each of Examples 2-1 to 2-3, the angle adjustment mechanism described above was used to change the intersection angle θ in the range of 37 to 45 degrees.

B. Test Result

Figure 23:
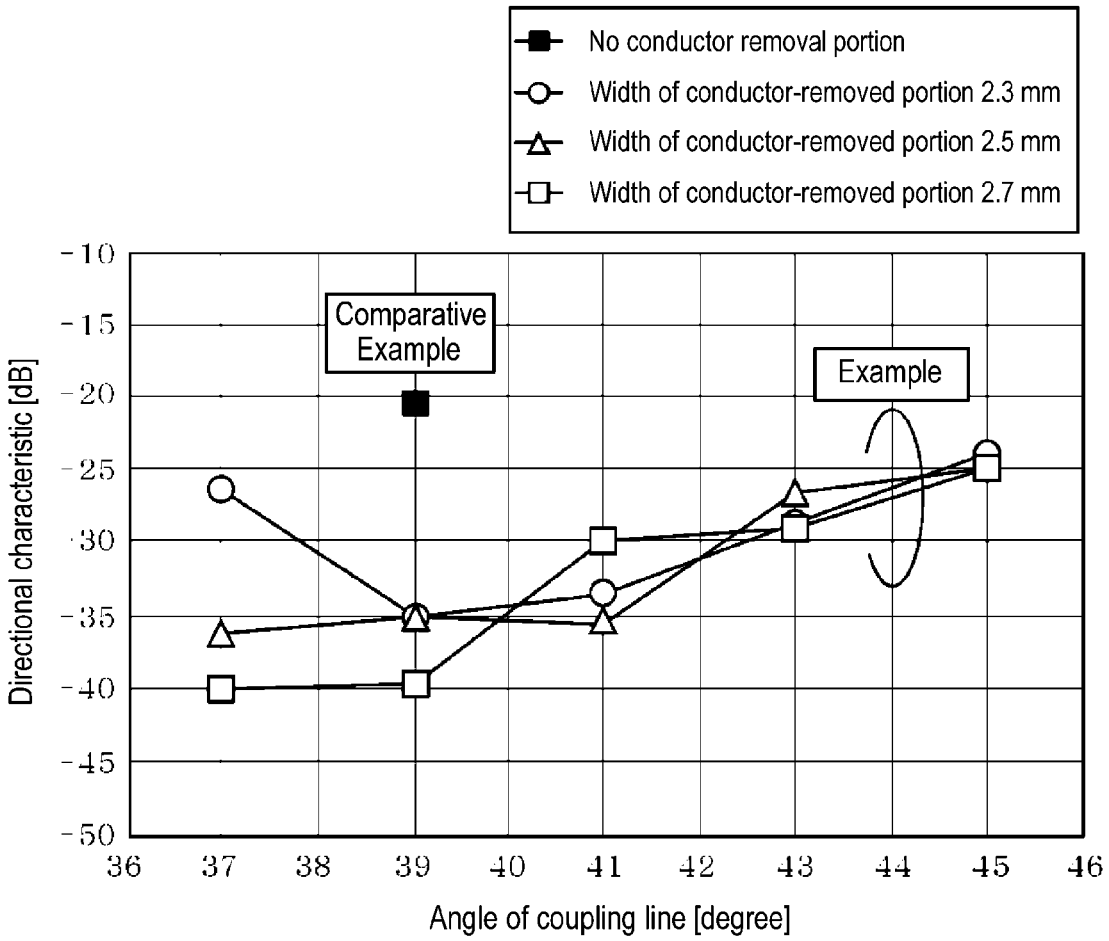
FIG. 23 is a characteristic diagram illustrating a change in directional characteristic with respect to an arrangement direction of a coupling line.

The test result is shown in FIG. 23. According to FIG. 23, in each of Examples 2-1 to 2-3, it was confirmed that when the intersection angle θ is changed was changed, the directional characteristic in dB was also changed. Therefore, it was confirmed that it is possible to obtain a directional coupler 6 having the more suitable directional characteristic by combining the width of the conductor-removed portion 67 and the intersection angle θ.

Further, as illustrated in FIG. 23, under a condition that the intersection angle θ is 39 degrees, the directional characteristic of the directional coupler of Comparative Example 2-1, in which no conductor-removed portion 67 was provided, was in the vicinity of −20 dB. In contrast, in the directional couplers 6 of Examples 2-1 to 2-3 provided with the conductor-removed portion 67, the directional characteristics were −30 dB or less (30 dB or more in absolute value) for widths of 2.3 mm, 2.5 mm and 2.7 mm, and thus good performance was obtained. As described above, it was confirmed that the directional characteristic of the directional coupler 6 can be improved by providing the conductor-removed portion 67 by removing a portion of the conductor film in the region facing the coupling line 68 via the dielectric substrate 65.

According to the present disclosure, it is possible to obtain a good directional characteristic of a directional coupler while loosely coupling a coupling line, which is an auxiliary line of the directional coupler, to a central conductor, which is a main line of the directional coupler.

While certain embodiments have been described, these embodiments have been presented by way of example only, and are not intended to limit the scope of the disclosures. Indeed, the embodiments described herein may be embodied in a variety of other forms. Furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A directional coupler for extracting portions of a high-frequency power, which flows through a main line, via an auxiliary line that is electromagnetically coupled to the main line, the directional coupler comprising:

a hollow coaxial line including a central conductor forming the main line and an outer conductor surrounding the central conductor and having an opening formed therein, wherein the hollow coaxial line is connected to an input terminal and an output terminal for the high-frequency power;

a dielectric substrate covering the opening and provided with film-shaped ground conductors, wherein a film-shaped ground conductor covers a rear surface of the dielectric substrate facing the central conductor via the opening and a film-shaped ground conductor covers a front surface of the dielectric substrate opposite to the rear surface, respectively, and are grounded; and a coupling line provided on the rear surface of the dielectric substrate at a location facing the central conductor via the opening, and formed in a region surrounded by the ground conductor formed on the rear surface such that the coupling line is electrically isolated from the ground conductor formed on the rear surface and serves as the auxiliary line, wherein the coupling line is connected to extraction terminals from which the portions of the high-frequency power are extracted, wherein the ground conductor formed on the front surface is provided with a non-conductive region in which a portion of a conductor film in a region facing the coupling line via the dielectric substrate is not formed, and wherein the non-conductive region is surrounded by the ground conductor formed on the front surface.

2. The directional coupler of claim 1, wherein the opening is a circular opening formed in a circular shape so as to encompass an entirety of the coupling line.

3. The directional coupler of claim 2, further comprising a spacer provided between the outer conductor and the dielectric substrate, wherein an opening is formed in the spacer and the rear surface of the dielectric substrate faces the central conductor via the opening formed in the outer conductor and the opening formed in the spacer.

4. The directional coupler of claim 3, wherein the ground conductor formed on the front surface and the ground conductor formed on the rear surface are electrically connected to each other via a through hole formed in the dielectric substrate.

5. The directional coupler of claim 4, wherein the central conductor is configured by a rod-shaped conductor, and the coupling line is configured by an elongated conductor film formed along the rear surface of the dielectric substrate, and wherein, when viewed from a direction along the front surface and the rear surface of the dielectric substrate, an extending direction of the rod-shaped conductor and an extending direction of the elongated conductor film are parallel to each other, and when viewed above from the front surface of the dielectric substrate, the extending direction of the rod-shaped conductor and the extending direction of the elongated conductor film intersect each other.

6. The directional coupler of claim 5, wherein the coupling line is formed such that an angle formed by the extending direction of the rod-shaped conductor and the extending direction of the elongated conductor film is a preset intersection angle.

7. The directional coupler of claim 6, wherein the intersection angle is adjusted by changing a mounting direction of the dielectric substrate with respect to the hollow coaxial line when viewed from the direction facing the front surface of the dielectric substrate.

8. The directional coupler of claim 7, wherein each of the extraction terminals is connected to one end of an extraction line formed in the non-conductive region on the front surface of the dielectric substrate, and the other end of the extraction line is connected to the coupling line via the through hole formed in the dielectric substrate.

9. The directional coupler of claim 1, further comprising a spacer provided between the outer conductor and the dielectric substrate, wherein an opening is formed in the spacer and the rear surface of the dielectric substrate faces the central conductor via the opening formed in the outer conductor and the opening formed in the spacer.

10. The directional coupler of claim 1, wherein the ground conductor formed on the front surface and the ground conductor formed on the rear surface are electrically connected to each other via a through hole formed in the dielectric substrate.

11. The directional coupler of claim 1, wherein the central conductor is configured by a rod-shaped conductor, and the coupling line is configured by an elongated conductor film formed along the rear surface of the dielectric substrate, and wherein, when viewed from a direction along the front surface and the rear surface of the dielectric substrate, an extending direction of the rod-shaped conductor and an extending direction of the elongated conductor film are parallel to each other, and when viewed above from the front surface of the dielectric substrate, the extending direction of the rod-shaped conductor and the extending direction of the elongated conductor film intersect each other.

12. The directional coupler of claim 1, wherein each of the extraction terminals is connected to one end of an extraction line formed in the non-conductive region on the front surface of the dielectric substrate, and the other end of the extraction line is connected to the coupling line via a through hole formed in the dielectric substrate.

13. The directional coupler of claim 12, wherein each of the extraction lines is provided with at least one element selected from an element group consisting of a low-pass filter configured to suppress high-frequency components contained in the portions of the high-frequency power, a high-pass filter configured to suppress low-frequency components contained in the portions of the high-frequency power, and an attenuator configured to attenuate a reflected wave from a side of each of the extraction terminals.

14. The directional coupler of claim 12, wherein each of the extraction lines is formed in the non-conductive region and constitutes a microstrip line with the ground conductor formed on the rear surface and the non-conductive region formed on the front surface defines regions on both sides of the extraction line to form a separation region having a width equal to or greater than a thickness of the dielectric substrate.

15. The directional coupler of claim 12, wherein each of the extraction lines is formed in the non-conductive region and constitutes a grounded coplanar line between the ground conductor formed on the front surface, and the non-conductive region defines regions on both sides of the extraction line, and the ground conductor formed on the rear surface.

16. The directional coupler of claim 1, wherein the extraction terminals comprise:

a traveling wave extraction terminal configured to extract a portion of traveling waves of the high-frequency power supplied from the input terminal via the coupling line; and a reflected wave extraction terminal configured to extract a portion of reflected waves of the high-frequency power output from the output terminal via the coupling line.

17. An apparatus for processing a wafer, the apparatus comprising:

a processing container in which the wafer is disposed;

a processing gas supplier configured to supply a processing gas into the processing container;

a plasma forming part configured to plasmarize the processing gas by supplying microwaves of a high-frequency power to the processing gas; and a microwave supplier configured to supply the microwaves to the plasma forming part, wherein a directional coupler for extracting portions of the high-frequency power, which flows through a main line, via an auxiliary line that is electromagnetically coupled to the main line is provided in a microwave supply path from the microwave supplier to the plasma forming part, and wherein the directional coupler comprises:

a hollow coaxial line including a central conductor forming the main line and an outer conductor surrounding the central conductor and having an opening formed therein, wherein the hollow coaxial line is connected to an input terminal and an output terminal for the high-frequency power;

a dielectric substrate covering the opening and provided with film-shaped ground conductors, wherein a film-shaped ground conductor covers a rear surface of the dielectric substrate facing the central conductor via the opening and a film-shaped ground conductor covers a front surface of the dielectric substrate opposite to the rear surface, respectively, and are grounded; and a coupling line provided on the rear surface of the dielectric substrate at a location facing the central conductor via the opening, and formed in a region surrounded by the ground conductor formed on the rear surface such that the coupling line is electrically isolated from the ground conductor formed on the rear surface and serves as the auxiliary line, wherein the coupling line is connected to extraction terminals from which the portions of the high-frequency power are extracted, wherein the ground conductor formed on the front surface is provided with a non-conductive region in which a portion of a conductor film in a region facing the coupling line via the dielectric substrate is not formed, and wherein the non-conductive region is surrounded by the ground conductor formed on the front surface.

18. The apparatus of claim 17, further comprising a power controller configured to perform at least one of adjusting an output of an amplifier provided in the microwave supply path and adjusting an impedance of a matcher provided in the microwave supply path, based on a result of extracting portions of the microwaves, which have been amplified by the amplifier, by using the directional coupler.

19. A method of processing a substrate a wafer, the method comprising:

supplying a processing gas to a processing container in which the wafer is disposed;

generating microwaves of a high-frequency power;

plasmarizing the processing gas by supplying the microwaves to the processing gas and processing the wafer by using the plasmarized processing gas; and extracting portions of the microwaves by using a directional coupler, which is provided in a supply path via which the microwaves is supplied to the processing gas, wherein the directional coupler is for extracting portions of the high-frequency power, which flows through a main line, via an auxiliary line that is electromagnetically coupled to the main line, and wherein the directional coupler comprises:

a hollow coaxial line including a central conductor forming the main line and an outer conductor surrounding the central conductor and having an opening formed therein, wherein the hollow coaxial line is connected to an input terminal and an output terminal for the high-frequency power;

a dielectric substrate covering the opening and provided with film-shaped ground conductors, wherein a film-shaped ground conductor covers a rear surface of the dielectric substrate facing the central conductor via the opening and a film-shaped ground conductor covers a front surface of the dielectric substrate opposite to the rear surface, respectively, and are grounded; and a coupling line provided on the rear surface of the dielectric substrate at a location facing the central conductor via the opening, and formed in a region surrounded by the ground conductor formed on the rear surface such that the coupling line is electrically isolated from the ground conductor formed on the rear surface and serves as the auxiliary line, wherein the coupling line is connected to extraction terminals from which the portions of the high-frequency power are extracted, wherein the ground conductor formed on the front surface is provided with a non-conductive region in which a portion of a conductor film in a region facing the coupling line via the dielectric substrate is not formed, and wherein the non-conductive region is surrounded by the ground conductor formed on the front surface.

20. The method of claim 19, wherein the extracting the portions of the microwaves includes:

amplifying the microwaves by using an amplifier;

extracting the portions of the amplified microwaves; and performing at least one of adjusting an output of the amplifier and adjusting an impedance of a matcher provided in the supply path, based on a result of extracting the portions of the microwaves.

* * * * *